US007515727B2

(12) United States Patent
Watanabe

(10) Patent No.: US 7,515,727 B2
(45) **Date of Patent: *Apr. 7, 2009**

(54) SPEAKER DEVICE AND METHOD OF MANUFACTURING THE SPEAKER DEVICE

(75) Inventor: Tomoyuki Watanabe, Yamagata (JP)

(73) Assignees: Pioneer Corporation, Tokyo (JP); Tohoku Pioneer Corporation, Tendo-Shi (JP)

( * ) Notice: Subject to any disclaimer, the term of this patent is extended or adjusted under 35 U.S.C. 154(b) by 697 days.

This patent is subject to a terminal disclaimer.

(21) Appl. No.: 11/084,114

(22) Filed: Mar. 21, 2005

(65) Prior Publication Data

US 2006/0018500 A1 Jan. 26, 2006

(30) Foreign Application Priority Data

Mar. 19, 2004 (JP) ..... 2004-080186

(51) Int. Cl.
*H04R 25/00* (2006.01)

(52) U.S. Cl. ..... 381/396; 381/407; 381/409; 381/410; 381/412

(58) Field of Classification Search ..... 381/403–405, 381/407, 409, 410, 412, 398, 423, 424
See application file for complete search history.

(56) References Cited

U.S. PATENT DOCUMENTS 6,088,466 A * 7/2000 Proni ..... 381/397
6,700,988 B2 * 3/2004 Wu ..... 381/404
7,263,198 B2 * 8/2007 Onuma ..... 381/403
2006/0088181 A1 * 4/2006 Kaiya et al. ..... 381/398

FOREIGN PATENT DOCUMENTS

JP 07-049908 2/1995

* cited by examiner

*Primary Examiner*—Suhan Ni
*Assistant Examiner*—Jasmine Pritchard
(74) *Attorney, Agent, or Firm*—Young & Thompson

(57) ABSTRACT

A speaker device includes a terminal member, a connecting member, a conductive damper and a diaphragm. The connecting member has a terminal mounting part. The terminal mounting part has a projecting part and a connecting part. The connecting member has a hole in its upper end portion and a fixing part at its lower end portion. The terminal member is mounted to the terminal mounting part. At this time, the projecting part is inserted into the hole, and the fixing part is inserted into a groove. Thereby, at positions of two spots, the terminal member is physically fixed to the connecting member. The connecting part is connected to the conductive member of the conductive damper. Thus, a soldering operation of the connecting part and the conductive member can be performed easily. Then soldering is performed for the terminal member, a lead wire of a voice coil and the conductive member. Thereafter, at the same time when the connecting member and the diaphragm are bonded with an adhesive, the terminal member is bonded to them. At the same time when the connecting member and the conductive damper are bonded with an adhesive, the terminal member is bonded to them. Thereby, they can be reliably fixed by one adhesive applying operation. Thus, reduction of assembling steps of the speaker device can be achieved.

4 Claims, 22 Drawing Sheets

SPEAKER DEVICE AND METHOD OF MANUFACTURING THE SPEAKER DEVICE

TECHNICAL FIELD

The present invention relates to a fixing structure of a connecting member and a terminal member in a speaker device.

BACKGROUND ART

An internal magnet type speaker device including a magnetic circuit including a planar magnet, a planar plate and a pot-shaped yoke, and a vibration system including a terminal member having conductivity, a conductive damper made by weaving a conductive member, a connecting member made of a resin material, a voice coil, a voice coil bobbin and a frame is conventionally known.

In such a speaker device, the connecting member movably supports the voice coil bobbin. Therefore, it is necessary to electrically connect lead wires of the voice coil and the conductive damper through an area in the vicinity of the connecting member.

A wiring structure to a conductive part on the damper, which facilitates the wiring operation and the like of an end part of the conductive part of the conductive damper and a terminal is known (for example, see Japanese Utility Model Publication No. 7-49908).

DISCLOSURE OF THE INVENTION

As an object to be achieved by the present invention, the above described object is cited as an example. The present invention has its object to provide a speaker device having a fixing structure of a terminal member and a connecting member by which the number of assembling steps of the speaker device can be reduced.

According to one aspect of the present invention, a speaker device includes a frame, a damper with an outer peripheral edge portion supported by the frame, a connecting member mounted to the damper and movably supporting a voice coil bobbin, and a terminal member electrically connected to an amplifier side and a voice coil side, wherein a projecting part projecting upward is formed at an upper end portion of the connecting member and a groove is formed in a lower end portion of the connecting member, wherein a hole in which the projecting part is inserted is formed in an upper end portion of the terminal member and a fixing part which is inserted into the groove is formed at a lower end portion of the terminal member, and wherein the terminal member is mounted to the connecting member in a state in which the projecting part is inserted into the hole and the fixing part is inserted into the groove.

In the above described speaker device, the hole is formed in the upper end portion of the terminal member and the fixing part is formed at the lower end portion of the terminal member. Meanwhile, the projecting part is formed at the upper end portion of the connecting member and the groove is formed in the lower end portion of the connecting member. Therefore, the terminal member can be physically fixed to the connecting member at the two positions by inserting the projecting part into the hole, and inserting the fixing part into the groove. Thereby, fixing strength of the terminal member and the connecting member can be enhanced.

In one mode of the above described speaker device, a projecting part projecting to a side of a center axis of the connecting member is formed in the groove, an opening into which the projecting part is inserted is formed in the fixing part, and the projecting part is inserted into the opening.

According to this mode, the projecting part projecting to the side of the center axis is formed in the groove of the connecting member. Meanwhile, the opening into which the projecting part is inserted is formed in the fixing part of the terminal member. The terminal member is mounted to the connecting member in the state in which the projecting part is inserted into its opening. Therefore, the terminal member has the structure in which it is difficult to release from the connecting member. Therefore, connecting strength of the terminal member and the connecting member can be further enhanced.

In another mode of the above described speaker device, a connecting part of the terminal member is connected to a conductive member of a conductive damper or a tinsel cord. Thereby, the connecting part of the terminal member is connected to the conductive member of the conductive damper or the tinsel cord by mounting the terminal member to the connecting member. Since the terminal member is fixed to the connecting member, the terminal member does not lift from the connecting member. Therefore, the soldering operation for the connecting part of the terminal member and the conductive member of the conductive damper or the tinsel cord can be easily performed. Thus, the connecting member, the conductive damper and the terminal member can be simultaneously bonded. Thus, the connecting member, the conductive damper and the terminal member can be firmly bonded by one adhesive applying operation. Therefore, reduction of the number of assembling steps of the speaker device can be achieved.

In another mode of the above described speaker device, an inner peripheral edge portion of a diaphragm is disposed at the upper end portion of the terminal member.

According to this mode, the upper end portion of the connecting member, the upper end portion of the terminal member and the inner peripheral portion of the diaphragm can be simultaneously bonded. Thus, the connecting member, the diaphragm and the terminal member can be firmly bonded by one adhesive applying operation. Therefore, reduction of the number of assembling steps of the speaker device can be achieved.

In another aspect of the present invention, a method of manufacturing a speaker device has the steps of fixing a terminal member to a connecting member by inserting a projecting part formed at an upper end portion of the connecting member into a hole formed in an upper end portion of the terminal member and inserting a fixing part formed at a lower end portion of the terminal member into a groove formed at a lower end portion of the connecting member, soldering a connecting part of the terminal member fixed to the connecting member and a conductive member of a conductive damper and soldering a lead wire of a voice coil to the upper end portion of the terminal member, simultaneously bonding the upper end portion of the terminal member, the upper end portion of the connecting member and the inner peripheral edge portion of the diaphragm, and simultaneously bonding the lower end portion of the terminal member, the lower end portion of the connecting member and the inner peripheral edge portion of the conductive damper.

According to the above described manufacturing method of the speaker device, the terminal member can be fixed to the connecting member by inserting the projecting part formed at the upper end portion of the connecting member into the hole formed in the upper end portion of the terminal member, and inserting the fixing part formed at the lower end portion of the terminal member into the groove formed in the lower end part of the connecting member. Thus, the fixing strength of the terminal member and the connecting member can be enhanced.

The connecting part of the terminal member fixed to the connecting member and the conductive member of the conductive damper can be soldered. Since the terminal member is reliably fixed without lifting from the connecting member, the soldering operation of the connecting part of the terminal member and the conductive member of the conductive damper can be easily performed. The portion of the lead wire of the voice coil connected to the upper end portion of the terminal member can be soldered. Thereby, the voice coil and the conductive damper are electrically connected.

The upper end portion of the terminal member, the upper end portion of the connecting member and the inner peripheral portion of the diaphragm are simultaneously bonded. Thus, the connecting member, the diaphragm and the terminal member can be bonded by one adhesive applying operation. Thereby, reduction of the number of assembling steps of the speaker device can be achieved.

The lower end portion of the terminal member, the lower end portion of the connecting member and the inner peripheral edge portion of the conductive damper can be simultaneously bonded. Thus, the connecting member, the conductive damper and the terminal member can be bonded by one adhesive applying operation. Thereby, reduction of the number of assembling steps of the speaker device can be achieved.

BEST MODE FOR CARRYING OUT THE INVENTION

A preferred embodiment of the present invention will be explained hereinafter with reference to the drawings. In this embodiment, fixing structures are provided in at least two spots that are a terminal member and a connecting member.

Figure 1:
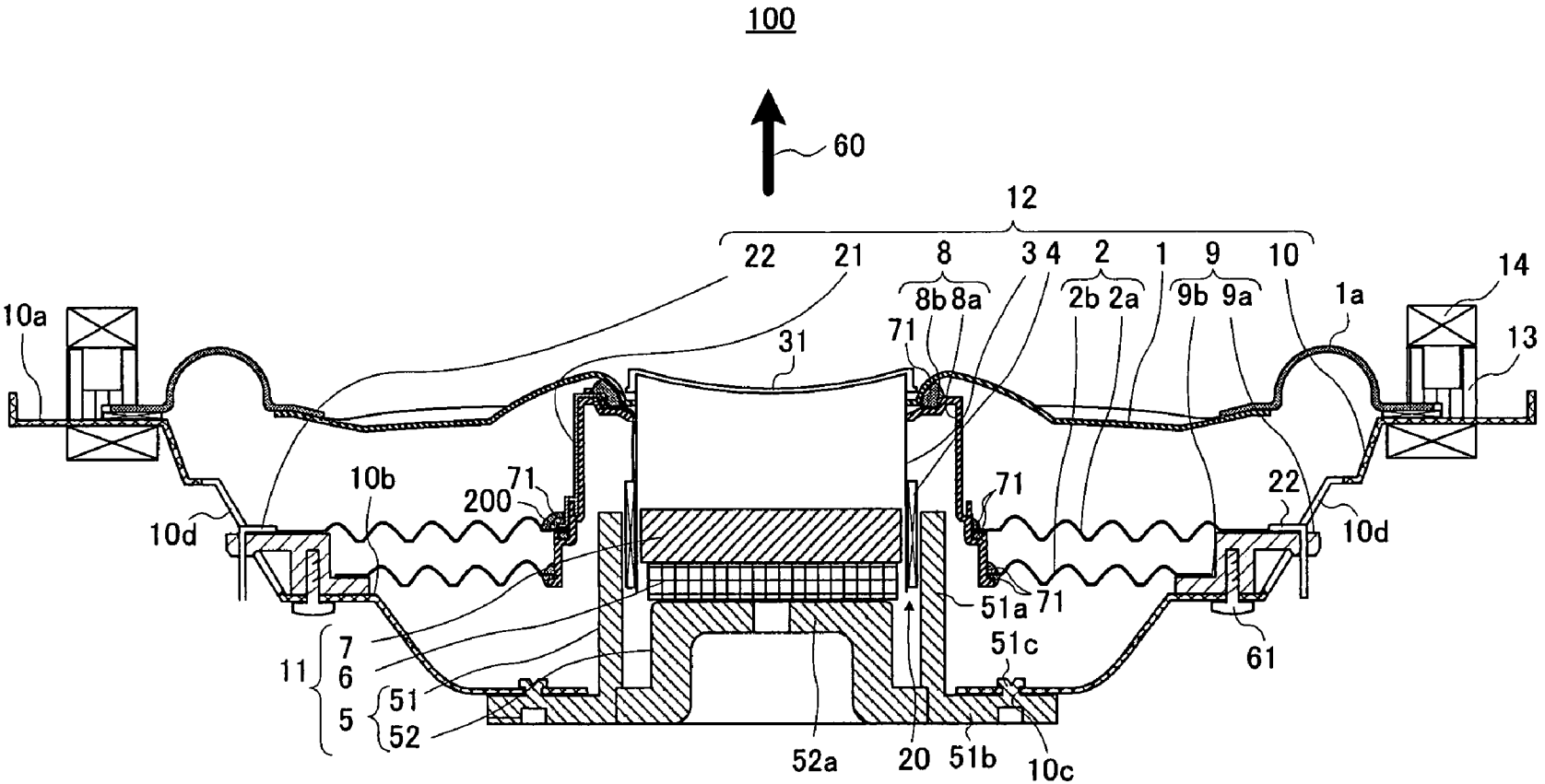
FIG. 1 shows a sectional view of a speaker device according to an embodiment of the present invention.
Figure 2:
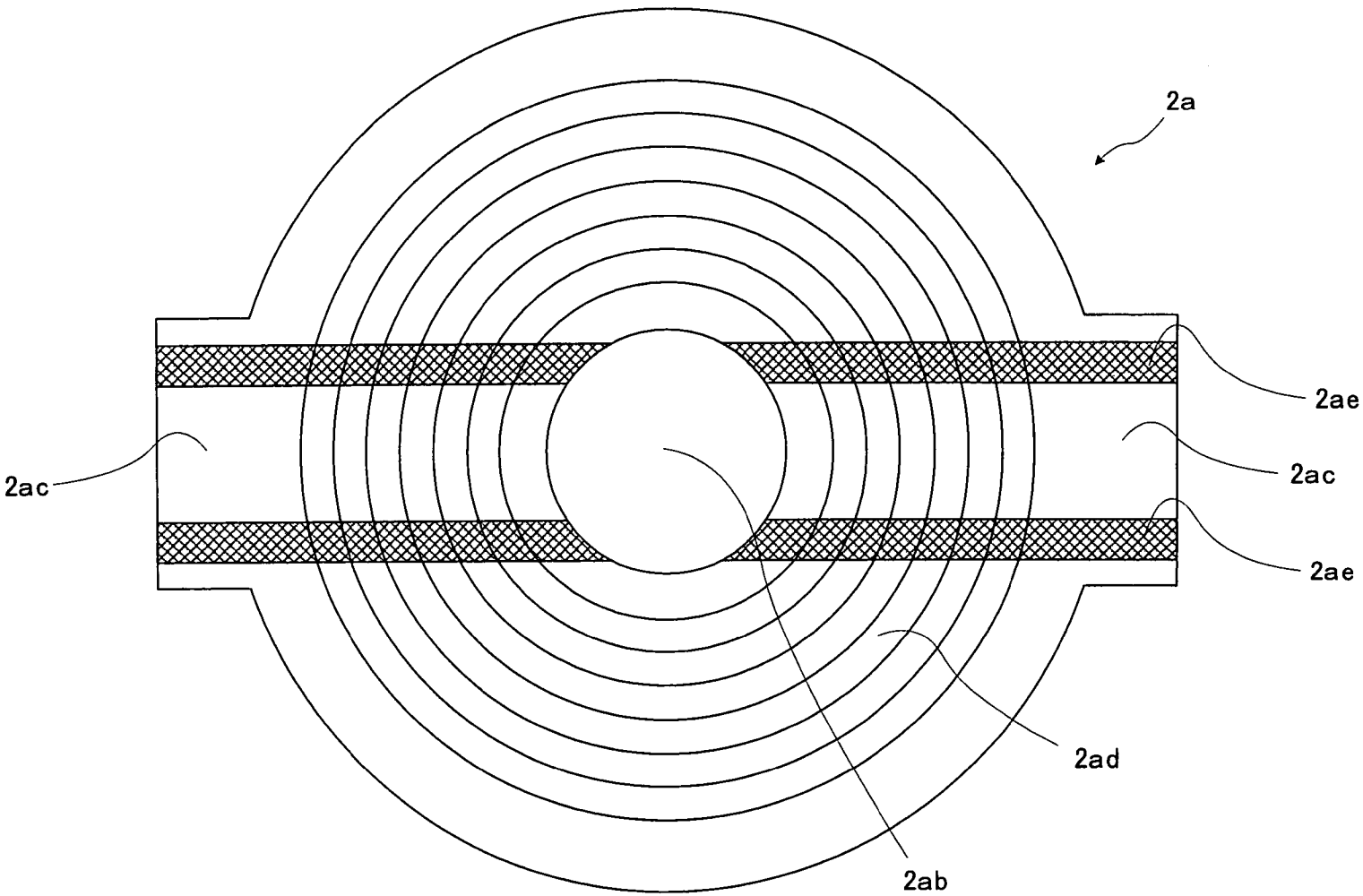
FIG. 2 shows a plane view of a conductive damper according to this embodiment.

FIG. 1 schematically shows a construction of a speaker device 100 according to the embodiment of the present invention. The speaker device 100 of this embodiment can be preferably used as the on-vehicle speaker. FIG. 1 shows a sectional view when cutting the speaker device 100 by a plane including a center axis thereof. FIG. 2 schematically shows a plane view of a conductive damper 2*a*. Referring to FIGS. 1 and 2, the construction and the like of the speaker device 100 of this embodiment will be explained hereinafter.

As shown in FIG. 1, the speaker device 100 mainly includes a vibration system 12 having a frame 10, a support member 9, a voice coil bobbin 3, a connecting member 8, a damper 2, terminal members 21, terminal members 22, a voice coil 4 and a diaphragm 1, a magnetic circuit system 11 having a pot type yoke 5, a magnet 6 and a plate 7, and an antidust cap 31 and various kinds of other members.

First, each of the components of the vibration system 12 will be explained.

Various components of the speaker device 100 are fixed to the frame 10, and the frame 10 has the function of supporting these components. The frame 10 is made of a metal material with favorable thermal conductivity. Therefore, the frame 10 has the function of a medium which transmits heat between an external space of the speaker device 100 and an internal space thereof. The frame 10 is formed into a pan-shape or a pot-shape which is opened upward, and has a first flange part 10*a* which is formed at an upper part and supports an outer peripheral edge portion or the like of the diaphragm 1, a second flange part 10*b* which is formed at an intermediate part and supports the support member 9, openings 10*c* formed in an inner peripheral edge portion, and a plurality of openings 10*d* formed at a side wall between the first flange part 10*a* and the flange part 10*b*. A plurality of openings 10*c* are formed in a circumferential direction of the inner peripheral edge portion with constant spaces between them. Each of projecting portions 51*c* of the pot-type yoke 5 before deformation, which will be described later, is inserted in each of the openings 10*c*.

The support member 9 is made of, for example, a resin material, and is formed into a substantially annular shape in the plane view. The support member 9 is formed into a step shape in the sectional view, and has an upper surface 9*a* and an upper surface 9*b*. The support member 9 is mounted to the second flange part 10*b* by a fixing member 61 such as a male screw and a bolt, for example.

The voice coil bobbin 3 is formed into a substantially cylindrical shape. The voice coil 4 is wound around an outer peripheral wall of a lower end portion of the voice coil bobbin 3. An inner peripheral wall of the lower end portion of the voice coil bobbin 3 is opposed to outer peripheral walls of the planar magnet 6 and plate 7 with a fixed space from them. Further, the outer peripheral wall of the lower end portion of the voice coil bobbin 3 is opposed to an outer peripheral wall of an upper end portion of a pole piece 5 with a fixed space apart from it. A clearance (a magnetic gap 20) is formed between the inner peripheral wall of the upper end portion of the pole piece 5 and the outer peripheral wall of the plate 7.

The connecting member 8 is made of a resin material, for example, and has a cylinder portion 8*a* formed into a substantially cylindrical shape and a bent portion 8*b* formed in a fashion being bent inwardly from an upper end of the cylinder portion 8*a*, and is made by integrally forming them. An inner peripheral edge portion of the connecting member 8, namely, the inner peripheral edge portion of the bent portion 8*b* is fixed to the vicinity of an upper end of the outer peripheral wall of the voice coil bobbin 3. The detailed construction of the connecting member 8 having a fixing structure of the present invention will be described later.

The damper 2 has a conductive damper 2*a* and an ordinary damper 2*b*.

The conductive damper 2*a* is disposed above the damper 2*b*. The conductive damper 2*a* includes an opening 2*ab*, a plurality of projecting parts 2*ac*, an elastic part 2*ad* and a plurality of conductive members 2*ae*.

The opening 2*ab* is formed substantially at a center of the conductive damper 2*a*. The connecting member 8 is inserted into this opening 2*ad*. A plurality of projecting parts 2*ac* are extended outside from an outer peripheral edge portion of the conductive damper 2*a* and are each formed into a substantially rectangular shape. The respective projecting parts 2*ac* are formed at the positions where they are symmetrical to each other as shown in FIG. 2. The respective projecting parts 2*ac* and the outer peripheral edge portion of the conductive damper 2*a* are respectively mounted to the upper surface 9*a* of the above described support member 9. The elastic part 2*ad* is formed into a corrugated shape, and plays a role of movably supporting the connecting member 8. A plurality of conductive members 2*ae* are formed by a conductive member and play a role of electrically connecting lead wires 4*a* of the voice coil 4 and the terminal members 21. Each of the conductive members 2*ae* is woven into a flat net shape at a top surface side of the conductive damper 2*a* from an inner peripheral edge portion of the conductive damper 2*a* to an end portion side of the projecting part 2*ac*. The conductive members 2*ae* at the side of the inner peripheral edge portion of the conductive damper 2*a* are electrically connected to connecting parts 21*c* of the respective positive/negative terminal members 21. Meanwhile, the conductive members 2*ae* at a side of the outer peripheral edge portion of the conductive damper 2*a* are electrically connected to one end sides of respective positive/negative terminal members 22.

The ordinary damper 2*b* is formed into substantially the same shape as the conductive damper 2*a*. However, the ordinary damper 2*b* does not have the conductive members 2*ae* unlike the conductive damper 2*a*. An outer peripheral edge portion of the ordinary damper 2*b* is fixed to the top surface 9*b* of the support member 9, and an inner peripheral edge portion of the damper 2*b* is fixed to the lower end portion of the connecting member 8 via an adhesive 71.

The terminal member 21 is a member of metal or the like having conductivity, and a plurality of the terminal members 21 are provided. Each of the terminal members 21 is mounted to the connecting member 8. The detailed construction of the terminal member 21 having the fixing structure of the present invention will be described later.

The terminal member 22 is a member having conductivity, and a plurality of terminal members 22 are provided. Each of the terminal members 22 is fixed to the top surface 9*a* of the support member 9. One end of each of the terminal members 22 is electrically connected to each of the conductive members of the conductive damper 2*a*, and the other end of each of the terminal members 22 is electrically connected to a relay wiring at the side of an amplifier not shown.

The voice coil 4 has a pair of plus/minus lead wires (not shown). The lead wire at the positive side is an input wiring for an L (or R)-channel signal, and the lead wire at the negative side is an input wiring for a ground (GND: ground) signal. Each of the lead wires is electrically connected to an upper end of each of the terminal members 21 as described above. Therefore, an electric signal of one channel is inputted into the voice coil 4 from the amplifier side via each of the terminal members 22, each of the conductive members of the conductive damper 2*a*, each of the terminal members 21 and each of the lead wires.

The diaphragm 1 is formed into a substantially planar shape to be made thin. Various kinds of materials such as paper, high polymer and metal can be applied to the diaphragm 1 in accordance with the various use purposes. An edge part 1*a* which is separate from the diaphragm 1 is mounted to an outer peripheral edge portion of the diaphragm 1. The outer peripheral edge portion of the diaphragm 1 is fixed to the first flange part 10*a*. Meanwhile, an inner peripheral edge portion of the diaphragm 1 is fixed to the vicinity of the upper end of the outer peripheral wall of the voice coil bobbin 3. The inner peripheral edge portion of the diaphragm 1 and the bent portion 8*b* of the connecting member 8 are fixed to each other via the adhesive 71.

Next, each component of the magnetic circuit system 11 will be explained.

The magnetic circuit system 11 is constructed as an internal magnet type magnetic circuit. This magnetic circuit has the pot type yoke 5, the planar magnet 6 and the planar plate 7.

The pot type yoke 5 has a body part 51 and a bottom part 52, and is formed by connecting them. The pot type yoke 5 is mounted to the frame 10.

The body part 51 has a cylinder part 51*a*, a flange part 51*b* and projecting parts 51*c* projecting upward from a top surface of the flange part 51*b*, and is made by integrally forming them. The cylindrical part 51*a* is formed into a substantially cylindrical shape. The cylinder part 51*a* extends upward from the vicinity of the inner periphery of the flange part 51*b* to the position in the vicinity of the plate 7. The flange part 51*b* extends in an outward direction substantially perpendicularly from the vicinity of the lower end of the outer peripheral wall of the cylindrical part 51*a*. The inner peripheral edge portion of the frame 10 is mounted to a top surface of the flange part 51*b*. The projecting part 51*c* is formed into a columnar shape, and a plurality of the projecting parts 51*c* are formed on the top surface of the flange part 51*b* with a constant space apart from each other. Each of the projecting parts 51*c* plays a role of fixing the inner peripheral edge portion of the frame 10 by being caulked.

The bottom part 52 has the sectional shape which is a substantially inversed recessed shape, and has a mounting part 52*a* which has substantially the same size as the diameters of the planar magnet 6 and the planar plate 7. The outer peripheral edge portion of the bottom part 52 is connected to the body part 51.

The planar magnet 6 is fixed onto the mounting part 52*a* of the bottom part 52 of the pot type yoke 5. The planar plate 7 is fixed onto the magnet 6. In the magnetic circuit system 11, the magnetic circuit is constructed by the magnet 6 and the plate 7, and a magnetic flux of the magnet 6 is concentrated to the magnetic gap 20 formed between the outer peripheral wall of the plate 7 and the inner peripheral wall of the pot type yoke 5.

The antidust cap 31 is mounted to an upper end portion of the voice coil bobbin 3 via an adhesive to close a top surface of the voice coil bobbin 3. Thereby, the antidust cap 31 has the function of preventing a foreign matter or the like from entering the inside of the speaker device 100.

Next, various kinds of components will be explained.

Various kinds of components include the members such as packing 13 and a buffering member 14.

The packing 13 is formed into an annular shape, and is a member having insulation properties. As a material of the packing 13, for example, a resin material is preferable. An undersurface of the packing 13 is fixed to the first flange part 10*a* and an outer peripheral edge portion of the edge part 1*a*, respectively. As a result, the outer peripheral edge portions of the diaphragm 1 and the edge part 1*a* are held between the packing 13 and the first flange part 10*a*.

The buffering member 14 has the function as the buffering member when the speaker device 100 is mounted to a predetermined position of a vehicle, for example, and has the function of preventing a vibration from an outside from being transmitted to the body of the speaker device 100. Therefore, a member of sponge or the like having cushioning properties is preferable as the material of the buffering member 14. The buffering member 14 is formed into a rod shape in the state before being mounted, with one side surface coated with an adhesive, or a double-side adhesive tape attached on the one side surface. The buffering member 14 is mounted on the top surface of the packing 13 via the adhesive or the double-side adhesive tape in the state in which it is deformed into an annular shape.

In the speaker device 100 described above, the electric signal outputted from the amplifier side is supplied to the voice coil 4 via each of the terminal parts 22, each of the conductive members of the conductive damper 2*a*, each of the terminal members 21, and each of the lead wires of the voice coil 4. Thereby, a driving force occurs to the voice coil 4 in the magnetic gap 20, which vibrates the diaphragm 1 in the axial direction of the speaker device 100. The speaker device 100 thus emits sound waves in the direction of the arrow 60.

[Fixing Structure and the like of Terminal Member and Connecting Member]

First Embodiment

Next, referring to FIGS. 3 to 8, a fixing structure and the like of the terminal member 21 and the connecting member 8 according to the first embodiment which makes the characteristics of the present invention will be described in detail.

Explaining the outline of the first embodiment, in the first embodiment, a hole is provided in an upper end portion of the terminal member 21, and a fixing part is provided at a lower end portion of the terminal member 21. A projecting part is provided at an upper end portion of the connecting member 8, and a groove is provided in the vicinity of a lower end of the connecting member 8. The projecting part of the connecting member 8 is inserted into the hole of the terminal member 21, and the fixing part of the terminal member 21 is inserted into the groove of the terminal member 8, whereby the terminal member 21 is mounted to the connecting member 8. Thereby, the terminal member 21 is reliably fixed to the connecting member 8 without fixing the terminal member 21 to the connecting member 8 with the adhesive.

Thereby, at the same time when the bent portion 8*b* of the connecting member 8 is bonded to the inner peripheral edge portion of the diaphragm 1 with the adhesive, the upper end portion of the terminal member 21 is bonded to them. At the same time when the outer peripheral wall of the connecting member 8 and the inner peripheral edge portion of the conductive damper 2*a* are bonded with the adhesive, the lower end portion of the terminal member 21 is bonded to them. The coating operation of the adhesive is finished at one time, and thereby, the number of assembling steps of the speaker device is reduced.

Figure 3C:
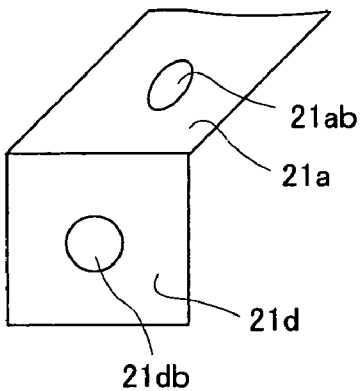
FIGS. 3A to 3C show perspective views of a terminal member according to a first embodiment.
Figure 3B:
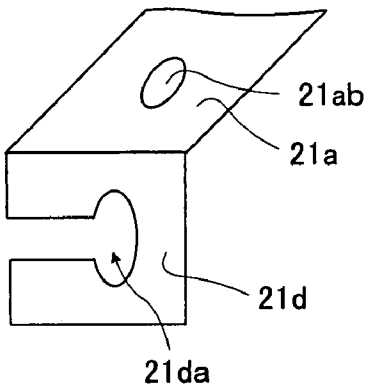
Figure 3A:
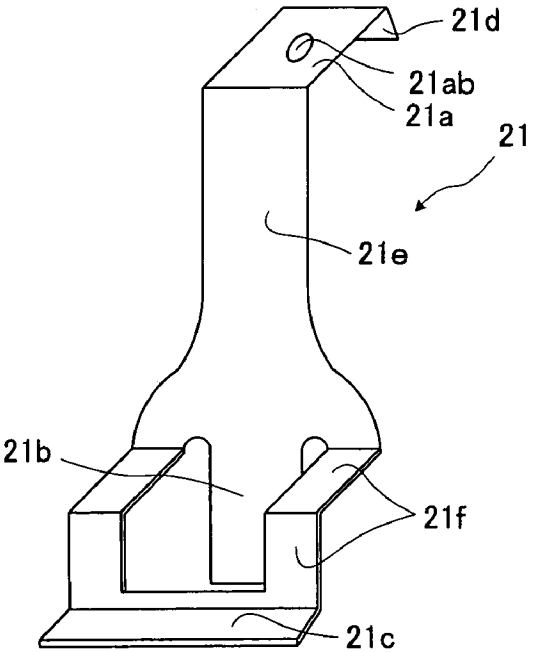
Figure 4:
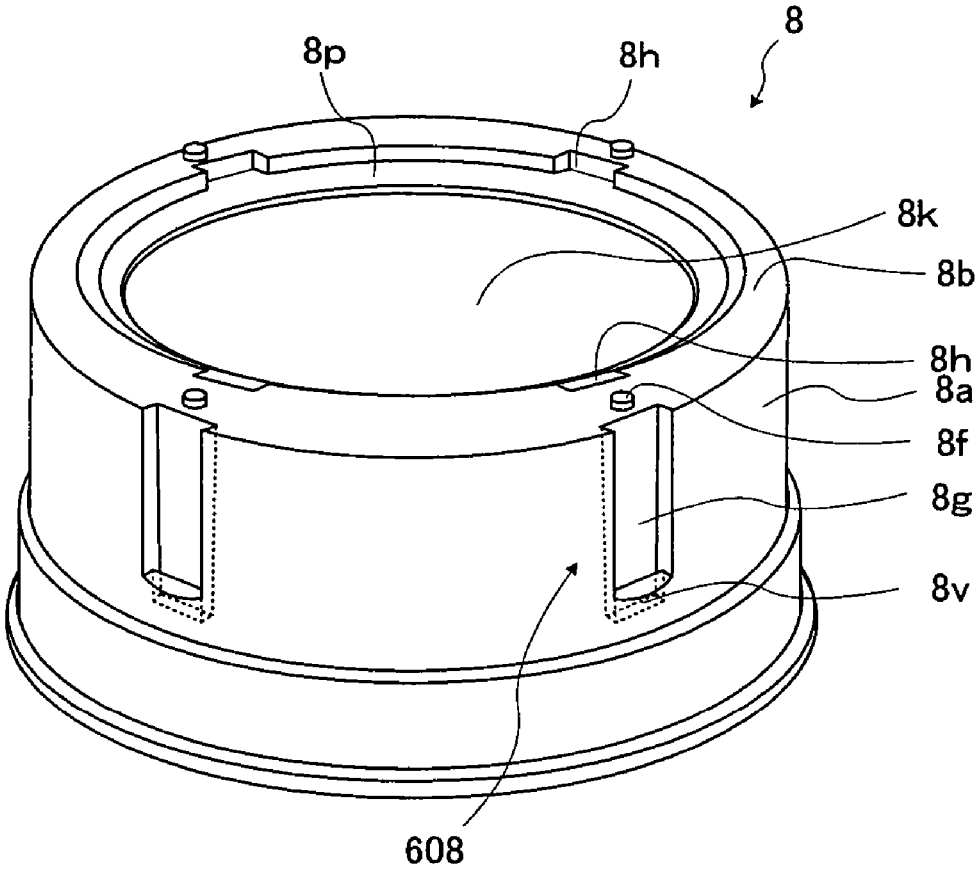
FIG. 4 shows a perspective view of a connecting member according to the first embodiment.
Figure 5A:
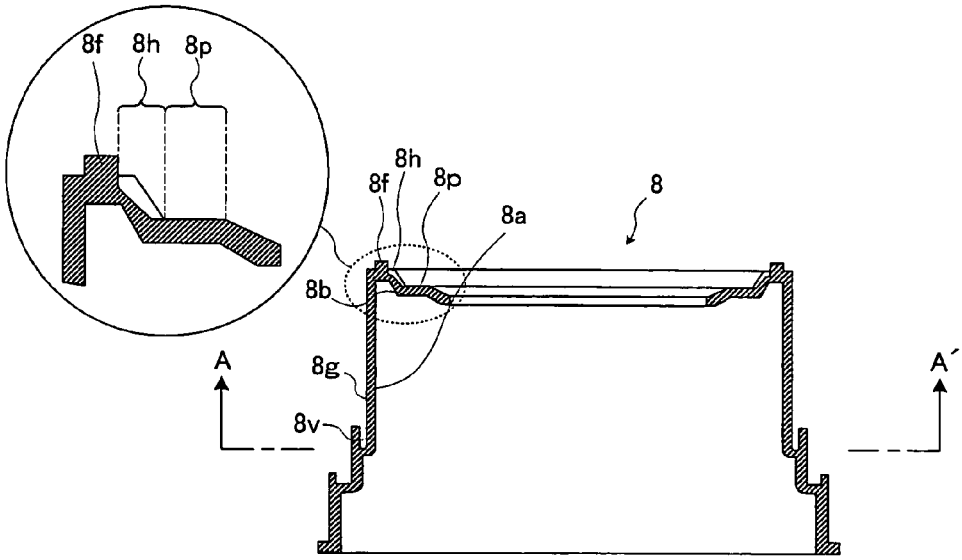
FIG. 5A shows a sectional view of a connecting member according to the first embodiment and FIG. 5B shows a plane view thereof.
Figure 5B:
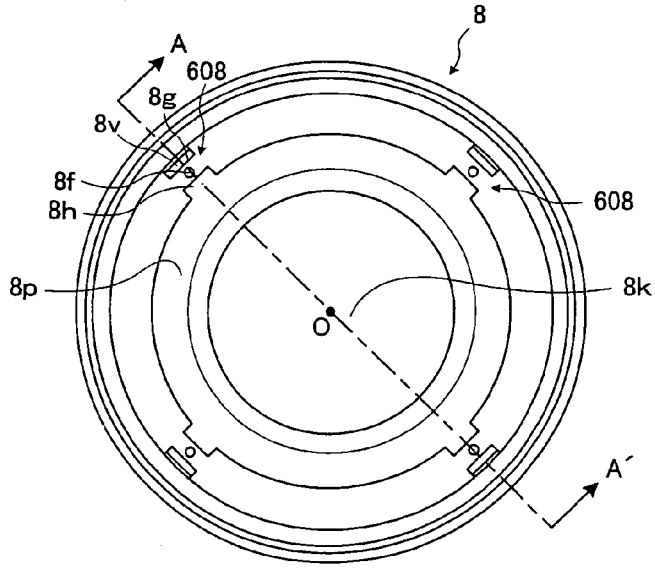
Figure 6:
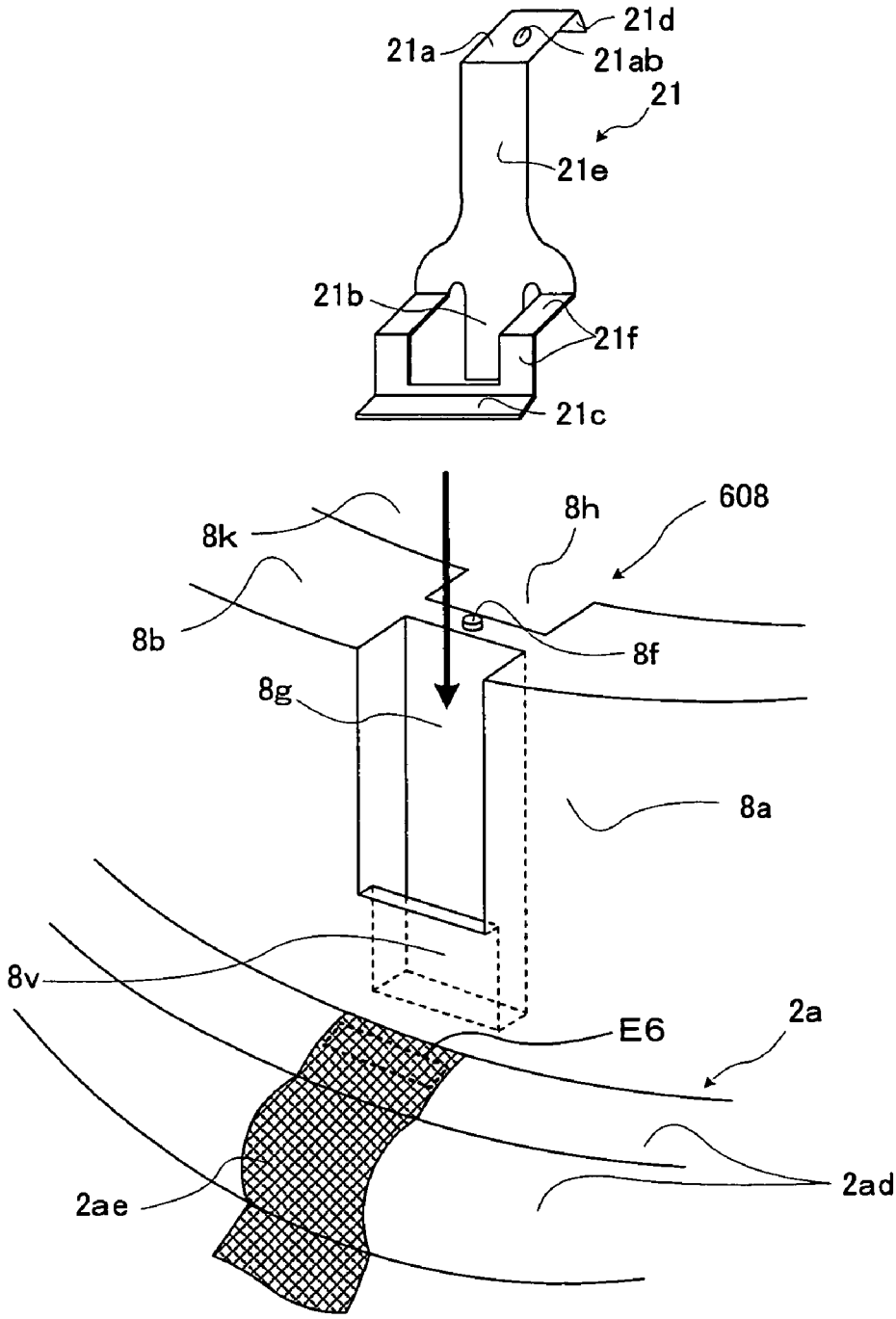
FIG. 6 is a perspective view of a local part of the connecting member and the like according to the first embodiment, showing a method for mounting the terminal member to the connecting member.
Figure 7B:
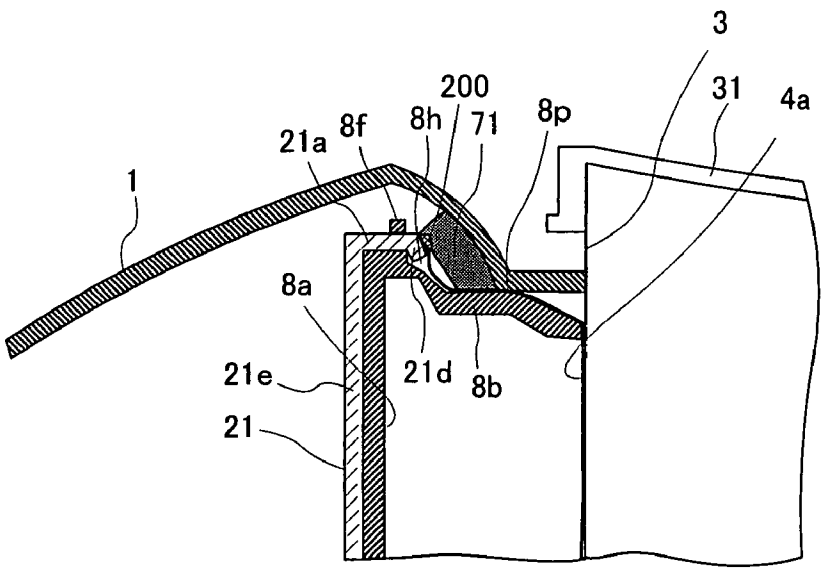
FIGS. 7A and 7B are sectional views of a local part of the speaker device according to the first embodiment in the state in which the terminal member is mounted to the connecting member.
Figure 7A:
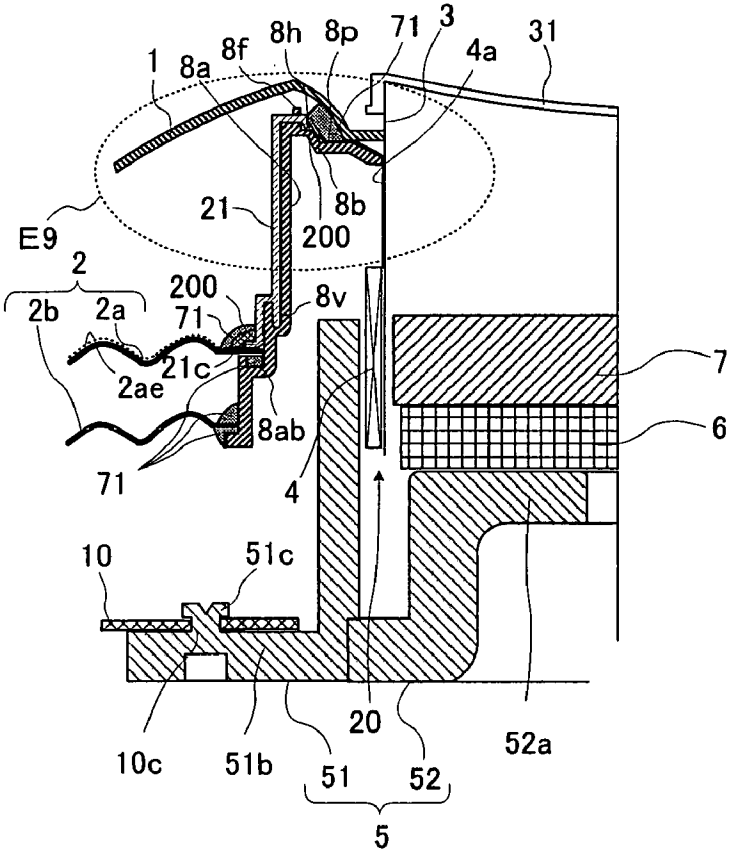
Figure 8:
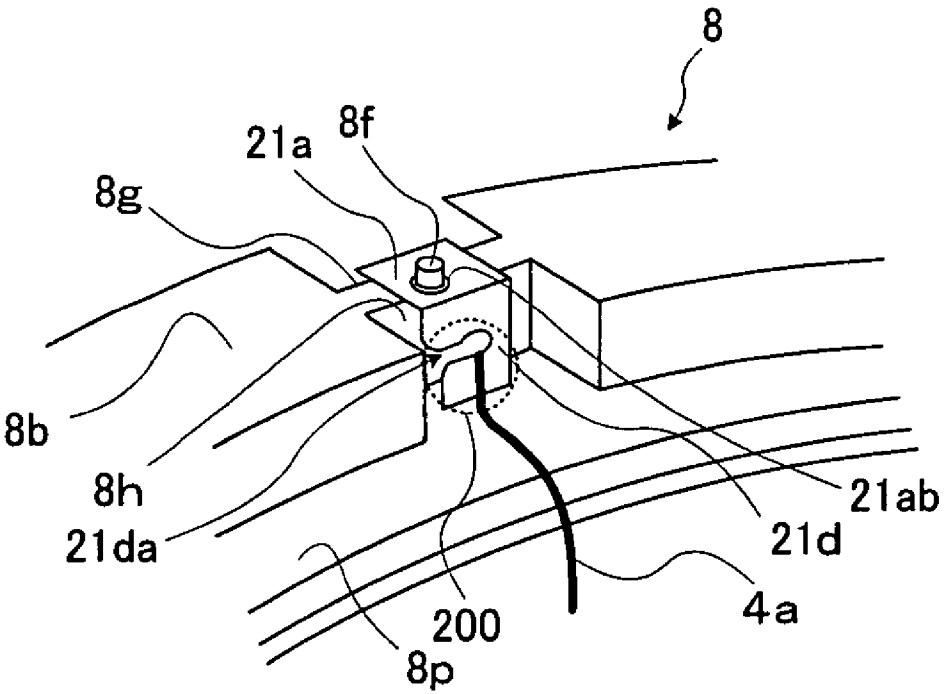
FIG. 8 is a perspective view of a local part of the connecting member and the like according to the first embodiment, showing a connecting method of a lead wire and the terminal member.

FIG. 3A shows a perspective view of the terminal member 21 according to the first embodiment. FIG. 3B shows a perspective view of an enlarged local part in the vicinity of a connecting part 21*d* in FIG. 3A. FIG. 3B shows an enlarged perspective view of a local part of the connecting part 21*d* where a slit 21*da* is formed. FIG. 3C shows an enlarged perspective view corresponding to the local part in the vicinity of the connecting part 21*d* of FIG. 3A. FIG. 3C also shows an enlarged perspective view of the local part of the connecting part 21*d* with a hole 21*db* formed, which is applicable to the terminal member 21. FIG. 4 shows a perspective view of the connecting member 8 according to the first embodiment. FIG. 5B shows a plane view of the connecting member 8 according to the first embodiment. FIG. 5A shows a sectional view taken along the cut line A-A' in FIG. 5B, and a sectional view of an enlarged part shown by the broken line in FIG. 5A. FIG. 6 shows a perspective view of an enlarged local part in the vicinity of a terminal mounting part of the connecting member 8. FIG. 6 is also a view explaining a method for mounting the terminal member 21 to the connecting member 8. FIG. 7A is an enlarged sectional view of a local part of the speaker device 100 in the state in which the terminal member 21 is mounted to the connecting member 8. FIG. 7B shows an enlarged sectional view of a part of a region E9 in FIG. 7A. FIG. 8 shows an enlarged perspective view of a local part in the vicinity of the connecting portions of the connecting part 21*d* and the connecting member 8. FIG. 8 is a view explaining a method for connecting the connecting part 21*d* and the lead wire 4*a* of the voice coil 4.

[Construction of Terminal Member]

First, referring to FIG. 3, a construction of the terminal member 21 according to the first embodiment will be explained in detail. The terminal member 21 includes a ceiling wall 21*a*, a connecting part 21*d*, a raised wall 21*e*, a fixing part 21*b*, bent parts 21*f* and a connecting part 21*c*.

The ceiling wall 21*a* is formed into a substantially rectangular shape, and has a hole 21*ab* substantially in its center. A projecting portion 8*f* of the connecting member 8 which will be described later is inserted into this hole 21*ab*. The connecting part 21*d* is formed by being folded to a lower side from one end side of the ceiling wall 21*a*. A slit 21*da* is formed in the connecting part 21*d* as shown in FIG. 3B. A lead wire 4*a* of the voice coil 4 is wound around this slit 21*da*. Thereby, the terminal member 21 and the lead wire 4*a* of the voice coil 4 are electrically connected. Without being limited to this, a hole 21*db* may be formed in the connecting part 21*d* as shown in FIG. 3C. In this case, the lead wire 4*a* of the voice coil 4 is wound around this hole 21*db*. The raised wall 21*e* extends substantially perpendicularly from the other end side of the ceiling wall 21*a* to the lower side. The fixing part 21*b* is formed into a substantially rectangular shape, and extends downward from the lower end portion of the raised wall 21*e*. The fixing part 21*b* is inserted into a groove 8*v* of the connecting member 8 which will be described later. The bent part 21*f* extends substantially perpendicularly to an outside from the lower end part side of the raised wall 21*a*, namely, extends to the opposite side from the direction in which the ceiling wall 21*a* extends, and is bent substantially perpendicularly to the down side at a predetermined position. The connecting part 21*c* extends substantially perpendicularly from the lower end portion side of the bent parts 21*f* to the outside, namely, extends in the opposite side of the direction in which the ceiling wall 21*a* extends. This connecting part 21*c* is connected to a conductive member 2*ae* of the conductive damper 2*a*.

[Construction of Connecting Member]

Next, referring to FIGS. 4 and 5, the connecting member 8 according to the first embodiment will be explained in detail.

The basic construction of the connecting member 8 is as described above. The connecting member 8 further includes an opening 8*k*, projecting portions 8*f*, slit portions 8*h*, grooves 8*v* and a flat surface 8*p*. A plurality of sets of projecting parts 8*f*, slit parts 8*h*, slit parts 8*g* and grooves 8*v* (hereinafter also called "a set of terminal mounting part 608") are formed in a circumferential direction of the connecting member 8 with constant spaces apart from each other. One terminal members 21 is mounted to one set of terminal mounting part 608.

The opening 8*k* is formed substantially at the center of the connecting member 8. The voice coil bobbin 3 is inserted into this opening 8*k*. The projecting portion 8*f* is formed into a substantially columnar shape, and projects upward from an upper end surface of the bent portion 8*b*. The projecting portion 8*f* is inserted into the hole 21*ab* of the terminal member 21. The slit portion 8*h* is the slit formed on the upper end surface of the bent portion 8*b* at the side of the center axis O. The connecting part 21*d* of the terminal member 21 is disposed in this slit portion 8*h*. The slit portion 8*g* is the slit formed in an outer peripheral wall of the cylindrical portion 8*a*. The slit portion 8*g* is formed from the upper end portion of the outer peripheral wall of the cylindrical portion 8*a* to the vicinity of the lower end of the outer peripheral wall of the cylinder portion 8*a*. The raised wall 21*e* of the terminal member 21 is disposed in this slip portion 8*g*. The groove 8*v* is the groove formed at the lower position of the slit portion 8*g*. The fixing part 21*b* of the terminal member 21 is inserted into this groove 8*v*. The flat surface 8*p* of the bent portion 8*b* has the flatness and the inner peripheral portion of the diaphragm 1 is mounted to it. The flat surface 8*p* and the slit portion 8*h* (white portion) are respectively the zones shown in the enlarged sectional view of FIG. 5A.

Next, referring to FIG. 6, a method for mounting the terminal member 21 to the connecting member 8 will be explained.

In order to mount the terminal member 21 to the connecting member 8, the terminal member 21 is mounted to a set of terminal mounting part 608 in the arrow direction in the drawing. At this time, the projecting portion 8*f* of the connecting member 8 is inserted into the hole 21*ab* of the terminal member 21, and the fixing part 21*b* of the terminal member 21 is inserted into the groove 8*v* of the connecting member 8. The upper end portion side of the terminal member 21 is fixed to the connecting member 8 by the projecting portion 8*f* of the connecting member 8, and a lower end portion side of the terminal member 21 is fixed to the connecting member 8 by the fixing part 21*b* of the terminal member 21. Thereby, the terminal member 21 is reliably fixed to the connecting member 8, and an undersurface of the connecting part 21*c* of the terminal member 21 is connected to a conductive member 2*ae* (the portion of the region E6) at the side of the inner peripheral edge portion of the conductive damper 2*a*.

Thereby, according to the fixing structure of the terminal member 21 and the connecting member 8, the terminal member 21 can be effectively prevented from lifting from the connecting member 8, and the soldering operation of the connecting part 21*c* and the conductive damper 2*a* can be easily performed.

The terminal member 21 is thus mounted to the connecting member 8, and the state in which the components of the speaker device 100 are mounted is shown in FIG. 7.

In such a state, as shown in FIG. 7B and FIG. 8, the connecting part 21*d* is disposed in the slit portion 8*h*, and the projecting portion 8*f* of the connecting member 8 is inserted into the hole 21*ab* of the connecting part 21. The undersurface of the ceiling wall 21*a* is in contact with the upper end surface of the bent portion 8*b*. The raised wall 21*e* is disposed in the slit portion 8*g* of the connecting member 8. The fixing part 21*b* is inserted into the groove 8*v*. The lead wire 4*a* lead out from the voice coil 4 is lead along the outer peripheral wall of the voice coil bobbin 3, the top surface of the bent portion 8*b* and the slit portion 8*h*, and is electrically connected to the connecting part 21*d* of the terminal member 21 by soldering as shown in FIG. 7B and FIG. 8. Meanwhile, the connecting part 21*c* of the terminal member 21 is electrically connected to the conductive member 2*ae* (see the broken line portion) at the side of the inner peripheral edge portion of the conductive damper 2*a* by soldering as shown in FIG. 7A.

As shown in FIG. 7B, the adhesive 71 is applied between the connecting part 21*d* of the terminal member 21 connected to the lead wire 4*a* via the soldering 200 and the bent portion 8*b* of the connecting member 8 and the inner peripheral portion of the diaphragm 1. As the applying method of this adhesive 71, the bent portion 8*b* of the connecting member 8 and the inner peripheral edge portion of the diaphragm 1 are bonded with the adhesive 71 and at the same time, the upper end portion of the terminal member 21 is bonded to them. Thereby, the upper end portion of the terminal member 21, the connecting member 8 and the diaphragm 1 are firmly bonded.

As shown in FIG. 7A, the adhesive 71 is applied between the connecting part 21*c* of the terminal member 21 connected to the conductive member 2*ae* via the soldering 200 and the connecting member 8 (not shown) in the vicinity of the connecting part 21*c*, and the conductive member 2*ae*. As the applying method of this adhesive 71, at the same time when the outer peripheral wall of the cylinder portion 8*a* of the connecting member 8 and the inner peripheral portion of the conductive damper 2*a* are bonded with the adhesive 71, the connecting part 21*c* of the terminal member 21 is bonded to them. Thereby, the lower end portion of the terminal member 21, the connecting member 8 and the conductive damper 2*a* are firmly bonded.

Therefore, the upper end portion of the terminal member 21, the connecting member 8 and the diaphragm 1 can be fixed by one applying operation of the adhesive 71, and the lower end portion of the terminal member 21, the connecting member 8 and the conductive damper 2*a* can be fixed. Thereby, the number of assembling steps of the speaker device 100 can be reduced.

Second Embodiment

Next, referring to FIGS. 9 to 13, a fixing structure and the like of a terminal member 21*x* and a connecting member 8*x* which make the characteristics of the present invention will be described in detail. The second embodiment provides the same effects as the first embodiment by making fixation of the terminal member 21*x* and the connecting member 8*x* firmer than the first embodiment.

Figure 9:
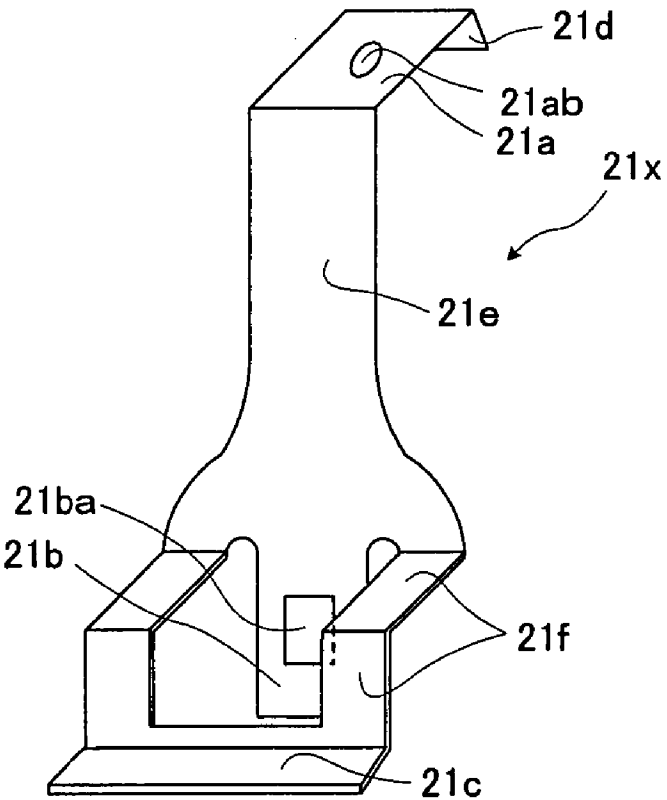
FIG. 9 shows a perspective view of a terminal member according to a second embodiment.
Figure 10:
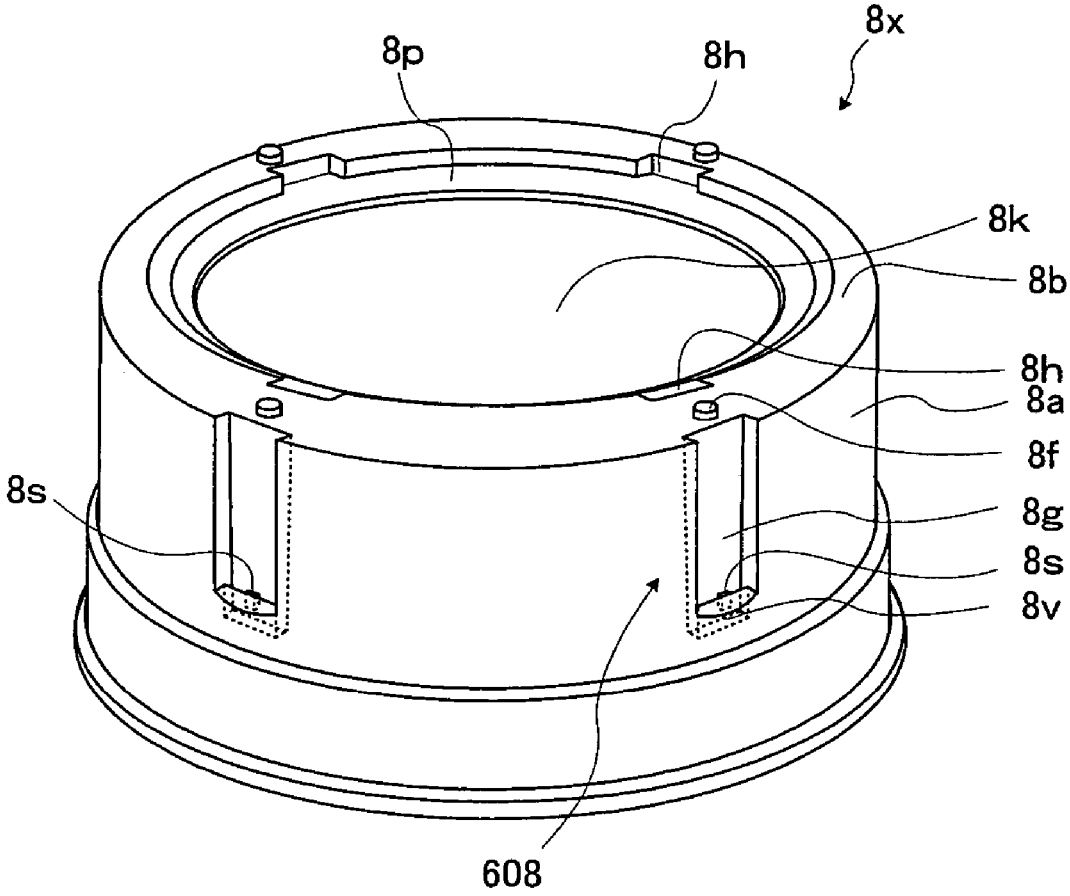
FIG. 10 shows a perspective view of a connecting member according to the second embodiment.
Figure 11A:
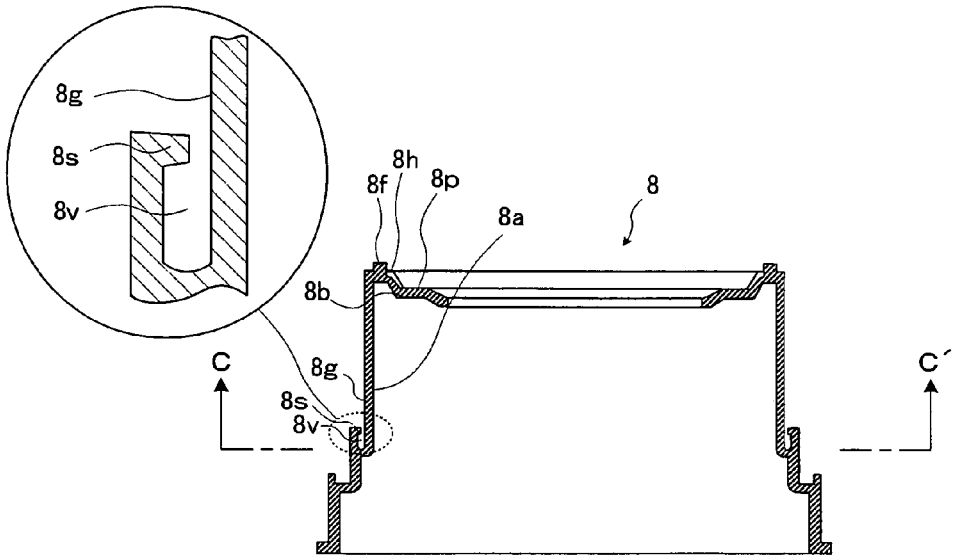
FIG. 11A shows a sectional view of the connecting member according to the second embodiment.
Figure 11B:
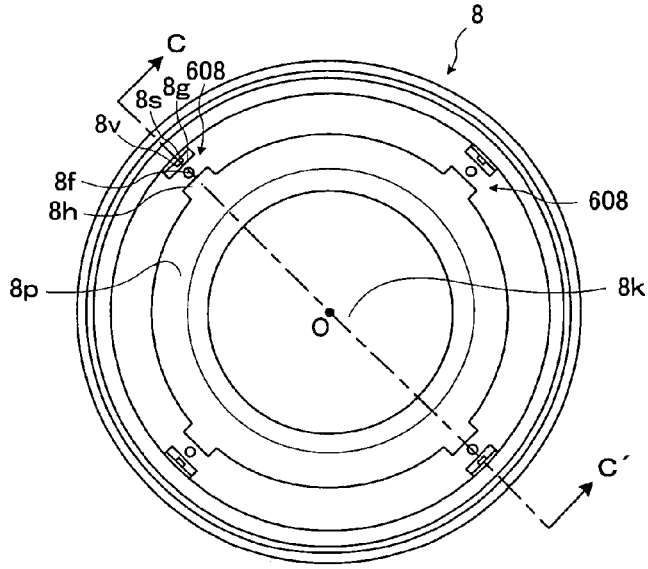
FIG. 11B shows a plane view thereof.
Figure 12:
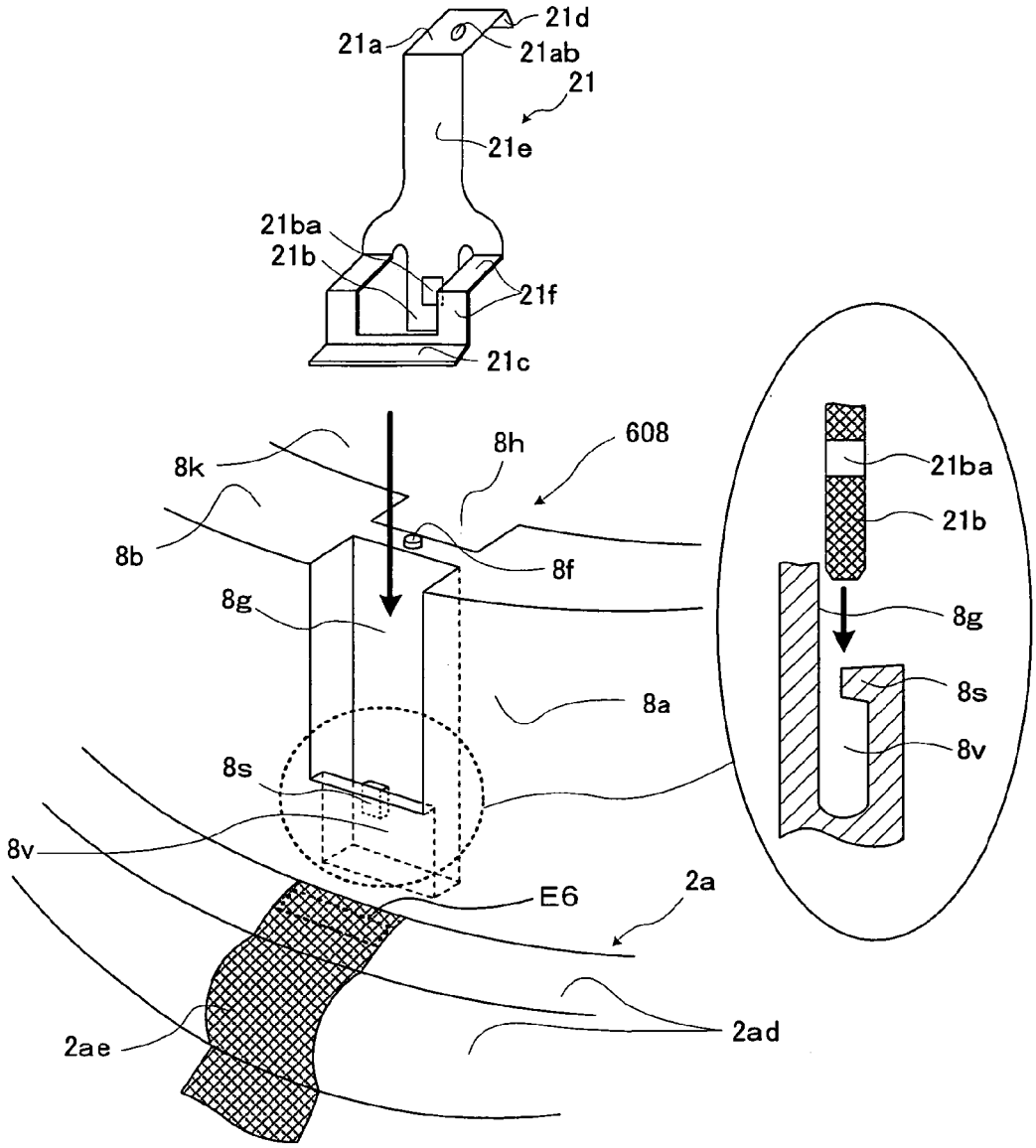
FIG. 12 is a perspective view of a local part of the connecting member and the like according to the second embodiment, showing a method for mounting the terminal member to the connecting member.
Figure 13B:
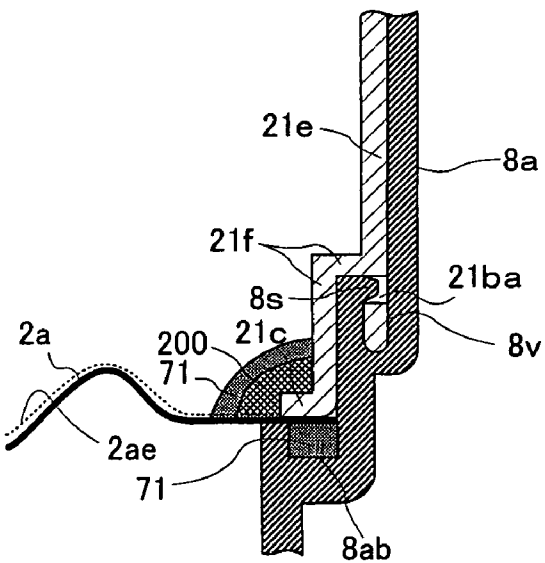
FIGS. 13A and 13B are sectional views of local parts of the speaker device according to the second embodiment in the state in which the terminal member is mounted to the connecting member.
Figure 13A:
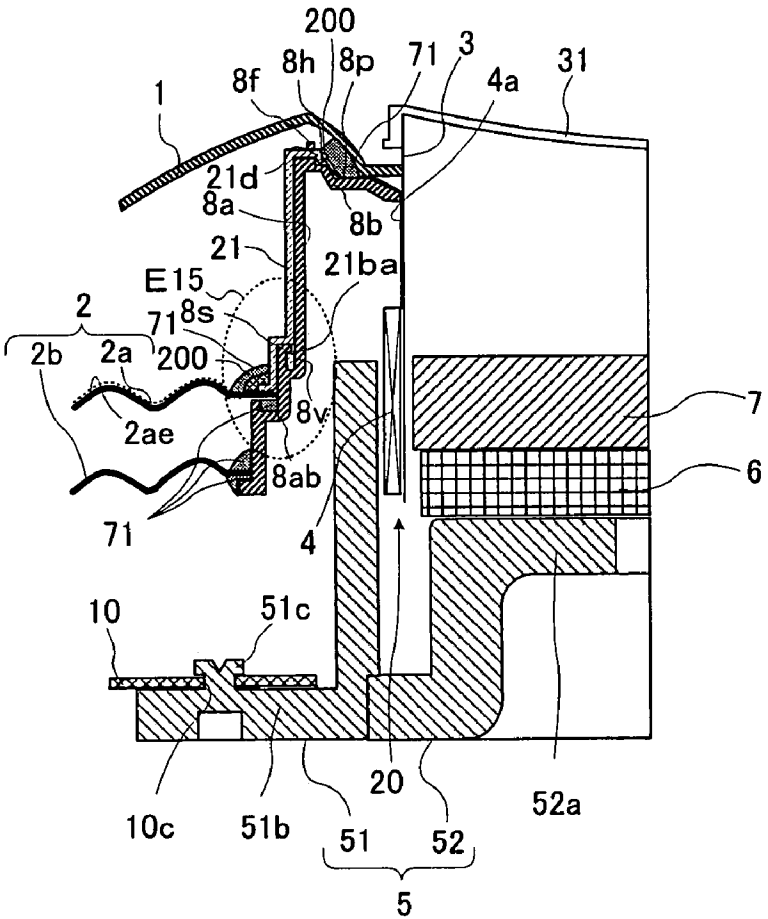

FIG. 9 shows a perspective view of the terminal member 21*x* according to the second embodiment. FIG. 10 shows a perspective view of the connecting member 8*x* according to the second embodiment. FIG. 11B shows a plane view of the connecting member 8*x* according to the second embodiment. FIG. 11A shows a sectional view taken along the cut line C-C' in FIG. 11B, and an enlarged sectional view of a portion of the broken line of FIG. 11A. FIG. 12 is an enlarged perspective view of a local part in the vicinity of a terminal mounting portion of the connecting member 8*x*, and an enlarged sectional view of a broken line portion of FIG. 12. FIG. 12 is also a view for explaining a method for mounting the terminal member 21*x* to the connecting member 8*x*. FIG. 13A shows an enlarged sectional view of a local part of the speaker device 100 in the state in which the terminal member 21*x* is mounted to the connecting member 8*x*. FIG. 13B shows an enlarged sectional view of a portion of a region E15 of FIG. 13A.

[Construction of Terminal Member 21*x*]

First, referring to FIG. 9, the construction of the terminal member 21*x* according to the second embodiment will be explained. In explaining the terminal member 21*x*, the same components as the components of the terminal member 21 according to the first embodiment are given the same reference numerals and characters, and the explanation thereof will be omitted.

The terminal member 21*x* has substantially the same construction as the terminal member 21 of the first embodiment. However, the terminal member 21*x* differs from the terminal member 21 in that it has an opening 21*ba* substantially at a center of the fixing part 21*b*. A projecting portion 8*s* of the connecting member 8*x* which will be described later is inserted into this opening 21*ba*.

[Construction of Connecting Member 8*x*]

Next, referring to FIGS. 10 and 11, the construction of the connecting member 8*x* according to the second embodiment will be explained. In explaining the connecting member 8*x*, the same components as the components of the connecting member 8 according to the first embodiment are given the same reference numerals and characters, and the explanation thereof will be omitted.

The connecting member 8*x* has substantially the same construction as the connecting member 8 of the first embodiment. However, the connecting member 8*x* differs from the connecting member 8 in that it has the projecting portion 8*s* formed into a substantially rectangular column shape at the side wall of the outer side of the groove 8*v* as shown. This projecting portion 8*s* projects to the side of the center axis O as shown in FIG. 11B. This projecting portion 8*s* has the function of fixing the fixing part 21*b* of the terminal member 21*x* by being inserted into the opening 21*ba* of the terminal member 21*x*.

Next, referring to FIG. 12, a method for mounting the terminal member 21*x* to the connecting member 8*x* will be explained.

In order to mount the terminal member 21*x* to the connecting member 8*x*, the terminal member 21*x* is mounted to a set of the terminal mounting part 608 in the direction of the arrow in the drawing. At this time, the projecting portion 8*f* of the connecting member 8*x* is inserted into the hole 21*ab* of the terminal member 21*x*. Thereby, an upper end portion side of the terminal member 21*x* is fixed to the connecting member 8*x*. As shown in the enlarged sectional view in the drawing, the fixed part 21*b* of the terminal member 21*x* is inserted into the groove 8*v* of the connecting member 8*x* in the arrow direction. Thereby, the projecting portion 8*s* is fitted into the opening 21*ba*. Thereby, the fixing part 21*b* of the terminal member 21*x* is fixed by the projecting portion 8*s* and the groove 8*v* of the connecting member 8*x*. Thereby, according to this fixing structure, the fixing strength of the terminal member 21*x* and the connecting member 8*x* can be enhanced more as compared with the first embodiment. Thereby, the undersurface of the connecting part 21*c* of the terminal member 21*x* is connected to the conductive member 2*ae* (portion of the region E6) at the side of the inner peripheral edge portion of the conductive damper 2*a*. Thus, according to the fixing structure of this terminal member 21*x* and the connecting member 8*x*, the terminal member 21*x* can be effectively prevented from lifting from the connecting member 8*x* as is understood by referring to FIG. 13B. Further, the soldering operation of the connecting part 21*c* and the conductive damper 2*a* can be easily performed. The state in which the terminal member 21*x* is thus mounted to the connecting member 8*x* and the components of the speaker device 100 are mounted is shown in FIG. 13A. The speaker device shown in FIG. 13A has substantially the same construction as the speaker device of the first embodiment shown in FIG. 7A, and therefore, the explanation will be omitted.

According to the fixing structure of the terminal member 21*x* and the connecting member 8*x* according to the second embodiment, the same effect as the first embodiment can be obtained, and the number of assembling steps of the speaker device can be reduced.

[Modified Example of the Connecting Member]

As for the construction of the groove of the connecting member which can fix the above described terminal members 21 and 21*x*, various modifications can be made.

Figure 14A:
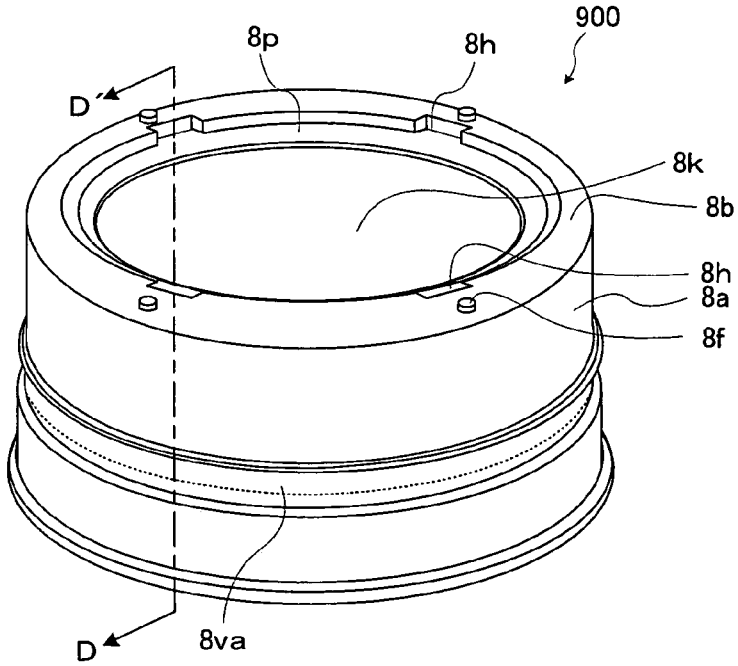
FIGS. 14A to 14D show perspective views and sectional views of connecting members according to modified examples.
Figure 14B:
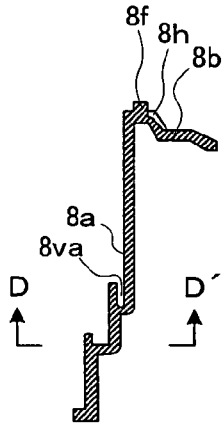

For example, in the connecting members 8 and 8*x* according to the above described first and second embodiments, the groove 8*v* is formed for each set of the terminal mounting parts 608, but without being limited to this, the groove may be formed on the entire circumference of the outer peripheral wall of the cylinder portion 8*a* of the connecting members 8 and 8*x*. FIG. 14A schematically shows a perspective view of a connecting member 900 in which such a groove 8*va* is formed. FIG. 14B shows a sectional view of a local part taken along the cut line D-D' of FIG. 14A.

The connecting member 900 has substantially the same construction as the connecting members 8 and 8*x* according to the first and second embodiments, but does not have the slit portion 8*g*. Instead, the groove 8*va* is formed in the vicinity of the lower end of the cylinder portion 8*a* along the circumferential direction of the outer peripheral wall of the cylinder portion 8*a*. The fixing parts 21*b* of the terminal members 21 or the like are inserted into this groove 8*va*. The mounting state of the terminal member 21 or the like to the connecting member 900 is omitted from the illustration. Thereby, the lower end part of the terminal member 21 or the like can be fixed, and the same effects as the connecting members 8 and 8*x* according to the first and second embodiments can be obtained. Further, when the mold for the connecting member 900 is manufactured, the groove 8*va* can be worked by lathe turning, and reduction in the cost of the mold can be achieved.

Figure 14C:
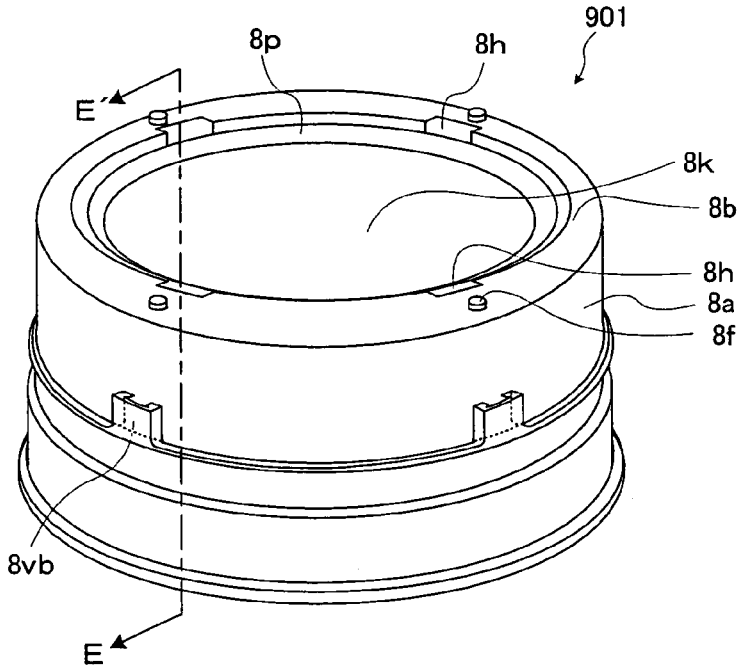
Figure 14D:
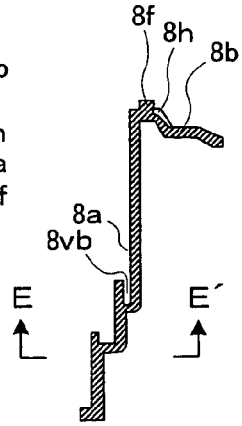

Various modifications can be made for the shape and the like of the groove formed in the connecting member. FIG. 14C schematically shows a perspective view of a connecting member 901 having one mode of such a groove. FIG. 14D shows a sectional view of a local part taken along the cut line E-E' of FIG. 14A.

The connecting member 901 has substantially the same construction as the connecting members 8 and 8*x* according to the first and second embodiments, but does not have the slit portion 8*g*. Instead, the connecting member 901 has grooves 8*vb* formed into the shape shown in the drawings. The fixing part 21*b* of the terminal member 21 or the like is inserted into this groove 8*vb*. The mounting state of the terminal member 21 or the like to the connecting member 901 is omitted from the illustration. Thereby, the lower end portion of the terminal member 21 or the like can be fixed, and the same effects as the connecting members 8 and 8*x* according to the first and second embodiments can be obtained.

[Other Application Examples]

Figure 15:
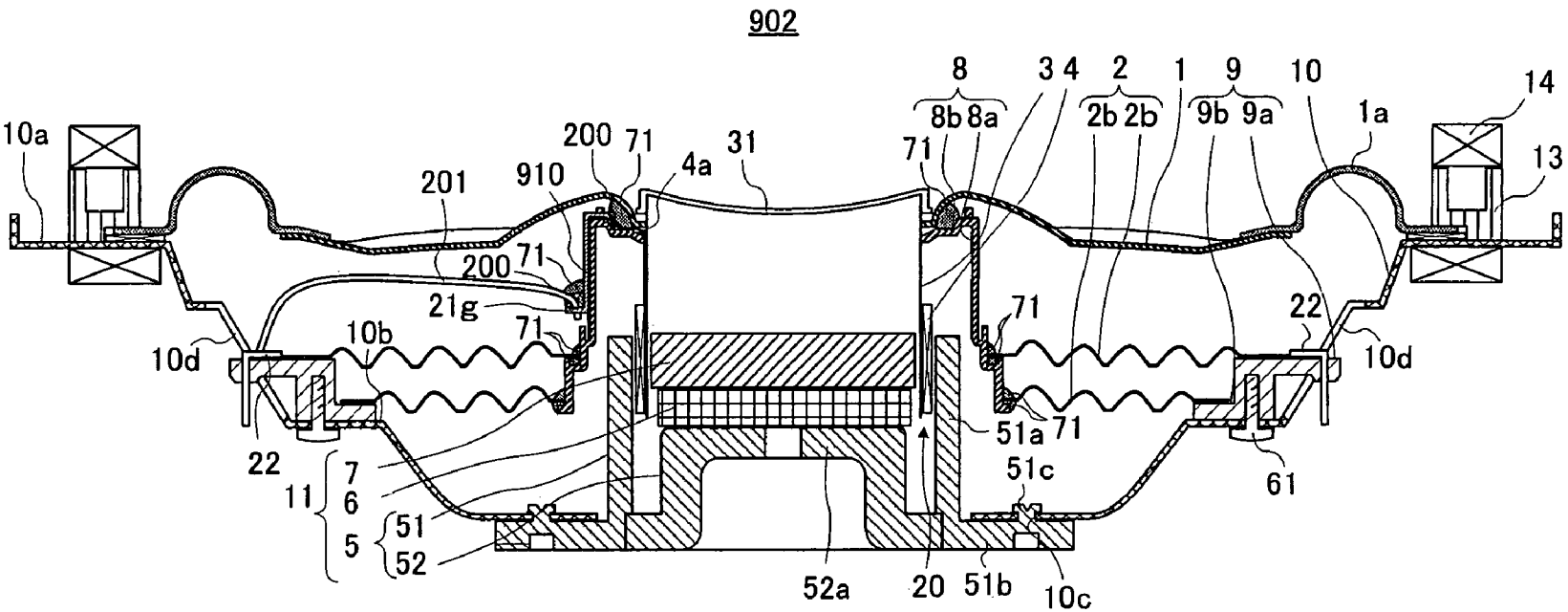
FIG. 15 shows a sectional view of a speaker device in which a fixing structure of the present invention is applied to a speaker having a tinsel cord.
Figure 16:
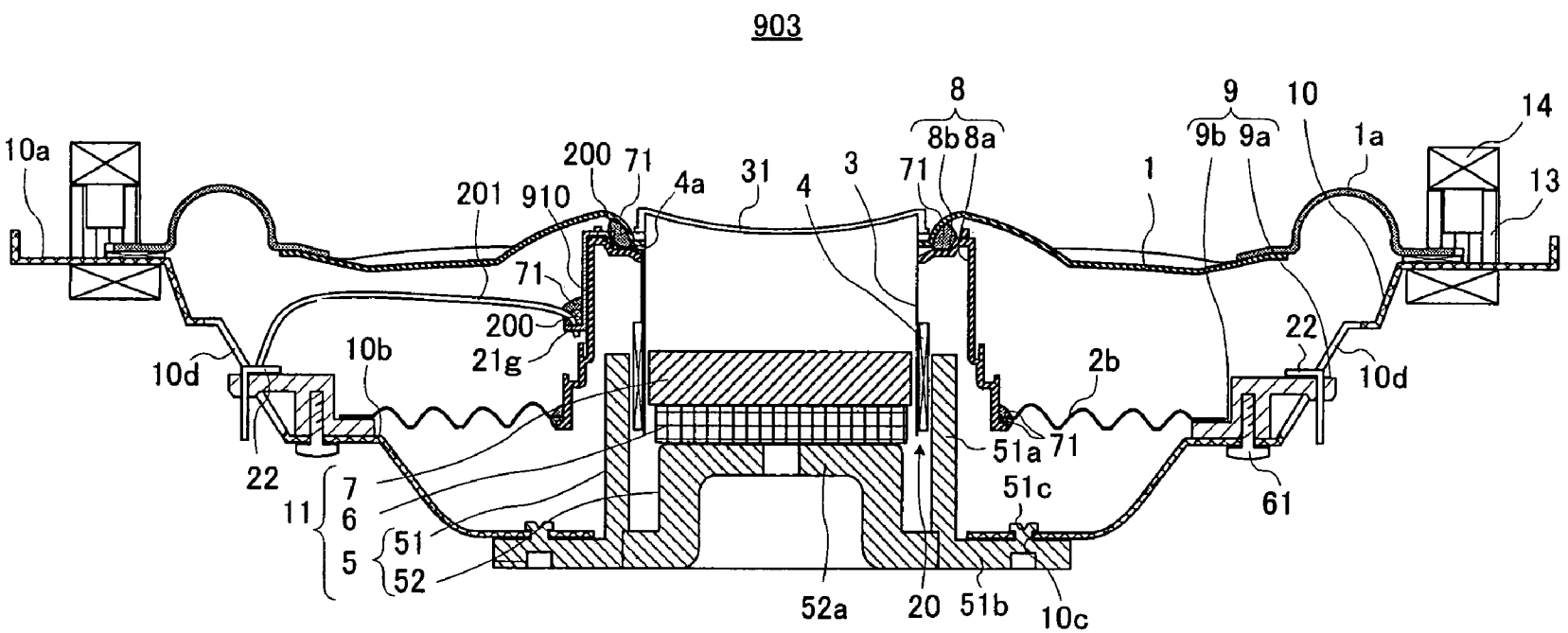
FIG. 16 shows a sectional view of a speaker device in which the fixing structure of the present invention is applied to the speaker device having the tinsel cord.

In the above described first and second embodiments, the present invention is applied to the speaker device 100 of the type in which the electric signal from the amplifier side is inputted into the voice coil 4 side through the conductive damper 2*a* and the like. However, without being limited to this, the present invention can also be applied to speakers 902 and 903 of a type in which the electric signal from the amplifier side is inputted to the voice coil 4 side through a tinsel cord 201 and the like as shown in FIGS. 15 and 16. FIG. 15 shows a sectional view of a speaker device 902 having the tinsel cord 201 and a plurality of ordinary dampers 2. FIG. 16 shows a sectional view of a speaker device 903 having the tinsel cord 201 and one ordinary damper 2. FIGS. 17A to 17D are perspective views schematically showing the constructions of the terminal members 904 to 907 applicable to the speaker devices 902 and 903, respectively.

Figure 17A:
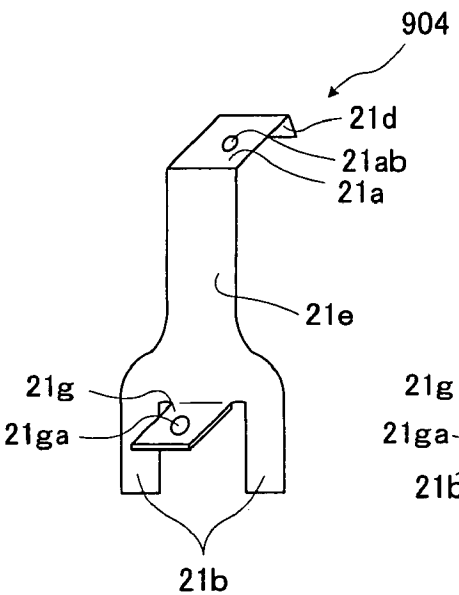
FIGS. 17A to 17D are perspective views showing various kinds of modes of the terminal members applicable to the speaker devices in FIG. 15 and FIG. 16.
Figure 17B:
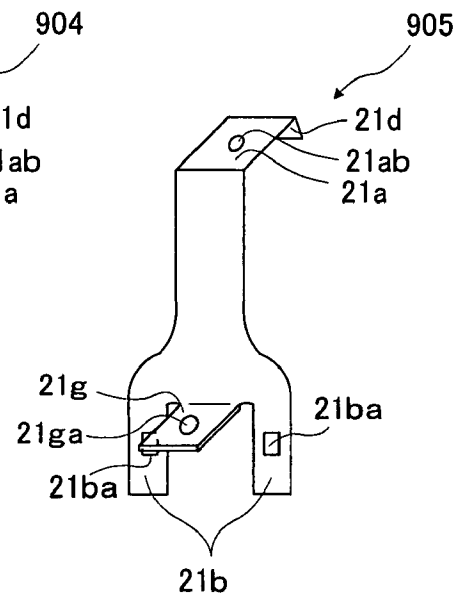
Figure 17C:
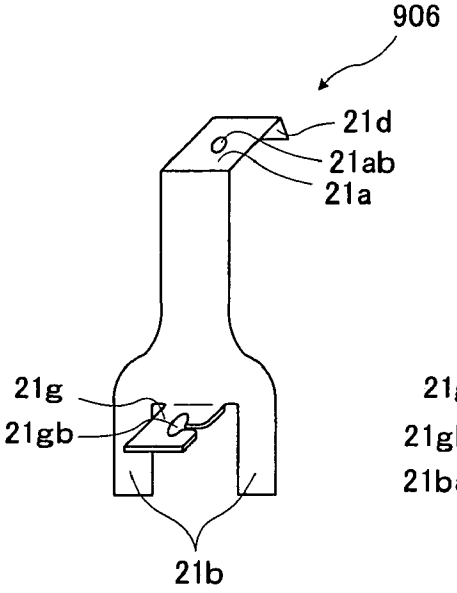
Figure 17D:
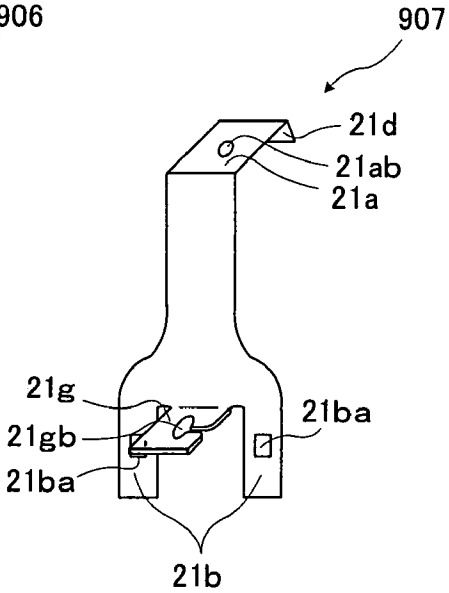

Prior to the explanation of the constructions of the speaker devices 902 and 903, the constructions of the terminal members 904 to 907 will be explained. FIG. 17A shows a perspective view of the terminal member 904. FIG. 17B shows a perspective view of the terminal member 905. FIG. 17C shows a perspective view of the terminal member 906. FIG. 17D shows a perspective view of the terminal member 907.

First, the construction of the terminal member 904 will be explained. Compared with the above described terminal member 21, the terminal member 904 does not have the bent part 21*f* and the connecting part 21*c* which are the components of the terminal member 21. Instead, the terminal member 904 has a connecting part 21*g* and a plurality of fixing parts 21*b*. The connecting part 21*g* extends to the outside from the lower end portion of the raised wall 21*e*, namely, to the opposite side of the direction in which the ceiling wall 21*a* extends as shown in FIG. 17A. A hole 21*ga* is formed substantially at a center of the connecting part 21*g*. One end side of the tinsel cord 201 is wound around this hole 21*ga*. A plurality of fixing parts 21*b* are inserted into the groove 8*v* of the connecting member 8. In this case, it is necessary to form the groove 8*v* to be a slightly wide so that a plurality of fixing parts 21*b* can be inserted into the groove 8*v*.

Next, a construction of the terminal member 905 will be explained. The terminal member 905 has substantially the same construction as the terminal member 904. However, the terminal member 905 has holes 21*ba* formed substantially at a center of the connecting parts 21*b*, unlike the terminal member 904. The projecting portion 8*s* formed inside the groove 8*v* of the connecting member 8 is inserted into this hole 21*ba*. In this case, it is necessary to form the groove 8*v* to be slightly wide so that a plurality of fixing parts 21*b* can be inserted into the groove 8*v*. At the same time as this, it is necessary to form a plurality of projecting parts 8*s* on the side wall of the outside of the groove 8*v* corresponding to the respective holes 21*ba*. Thereby, the lower end portion of the terminal member 905 can be reliably fixed to the connecting member 8.

Next, a construction of the terminal member 906 will be explained. The terminal member 906 has substantially the same construction as the terminal member 904. However, the terminal member 906 has a slit 21*gb* formed in the connecting part 21*g* instead of the hole 21*ga* unlike the terminal member 904. One end side of the tinsel cord 201 is wound around this slit 21*gb*.

Next, a construction of the terminal member 907 will be explained. The terminal member 907 has substantially the same construction as the terminal member 906. However, the terminal member 907 has holes 21*ba* formed substantially at the center of the connecting parts 21*b*, unlike the terminal member 906. The projecting portion 8*s* formed in the groove 8*v* of the connecting member 8 is inserted into this hole 21*ba*. In this case, it is necessary to form the groove 8*v* slightly wide so that a plurality of fixing parts 21*b* can be inserted. At the same time, it is necessary to form a plurality of projecting parts 8*s* at the side wall of the outside of the groove 8*v* corresponding to each of the holes 21*ba*. Thereby, the lower end portion of the terminal member 907 can be reliably fixed to the connecting member 8.

If any one of the terminal members (hereinafter, called "terminal member 910") of the terminal members 904 to 907 described above is applied to the speaker device 902 or 903, the tinsel cord 201 and the terminal member 910 can be electrically connected easily by winding one end side of the tinsel cord 201 around the hole 21*ga* or the slit 21*gb*.

Next, referring to FIG. 15 and FIG. 16, the construction or the like of the speaker device 902 or 903 to which such a terminal member 910 is applied will be briefly described.

The speaker device 902 has substantially the same construction as the speaker device 100. However, the speaker device 902 does not have the conductive damper 2*a* unlike the speaker device 100. Instead, the speaker device 902 has a plurality of ordinary dampers 2*b* and the tinsel cord 201. Therefore, in this speaker device 902, the terminal member 22 connected to the amplifier side, the tinsel cord 201, the terminal member 910 and the voice coil 4 are electrically connected.

Namely, as shown in the drawing, the one end side of the tinsel cord 201 is connected to the connecting part 21*g* of the terminal member 910. The contact portions of the connecting part 21*g* and the tinsel cord 201 are soldered. Meanwhile, the other end side of the tinsel cord 201 is connected to the one end side of the terminal member 22. Thereby, in the speaker device 902, the relay wiring at the amplifier side, the terminal member 22, the tinsel cord 201, the terminal member 910 and the lead wire 4*a* of the voice coil 4 are electrically connected.

In this speaker device 902, the terminal member 910 is reliably fixed to the connecting member 8 by the same method as the above described first and second embodiments. Thereby, in the speaker device 902, at the same time when the bent portion 8*b* of the connecting member 8 and the inner peripheral edge portion of the diaphragm 1 are bonded with the adhesive 71, the upper end portion of the terminal member 910 can be bonded to them. After the tinsel cord 201 is soldered to the connecting part 21*g* of the terminal member 910, this portion is reinforced with the adhesive 71 and at the same time, the terminal member 910 and the tinsel cord 201 or the like can be bonded. Therefore, by one applying operation of the adhesive 71, the upper end portion of the terminal member 910, the connecting member 8 and the diaphragm 1 can be fixed, and the connecting part 21*g* of the terminal member 910 and the tinsel cord 201 or the like can be fixed. Thereby, the number of assembling steps of the speaker device 902 can be reduced.

The speaker device 903 has substantially the same construction as the speaker device 902. However, the speaker device 903 has only one ordinary damper 2, and differs from the speaker device 902 in this respect. Namely, the present invention is also applicable to the speaker device 903 having one ordinary damper 2. Thus, in the speaker device 903, the same effect as the above described speaker device 902 can be obtained.

[Manufacturing Method of Speaker Device 100]

Figure 18:
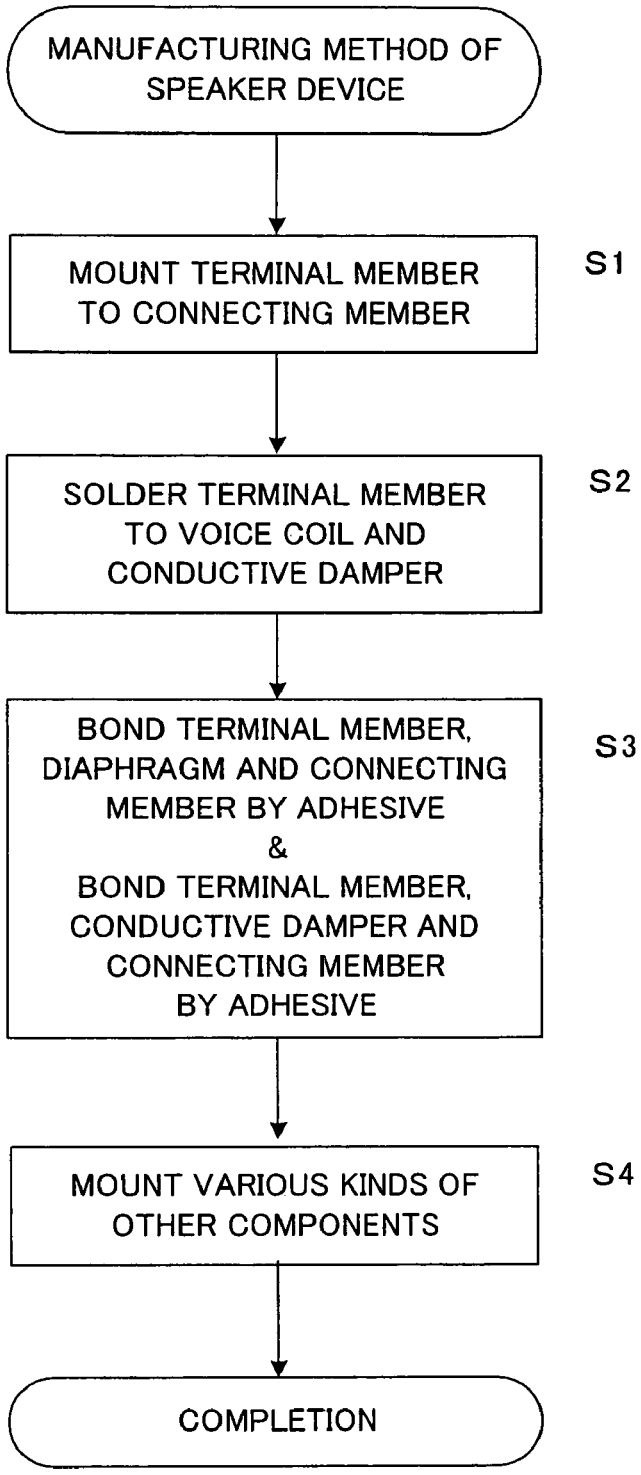
FIG. 18 shows a flow chart of a manufacturing method of the speaker device.
Figure 19:
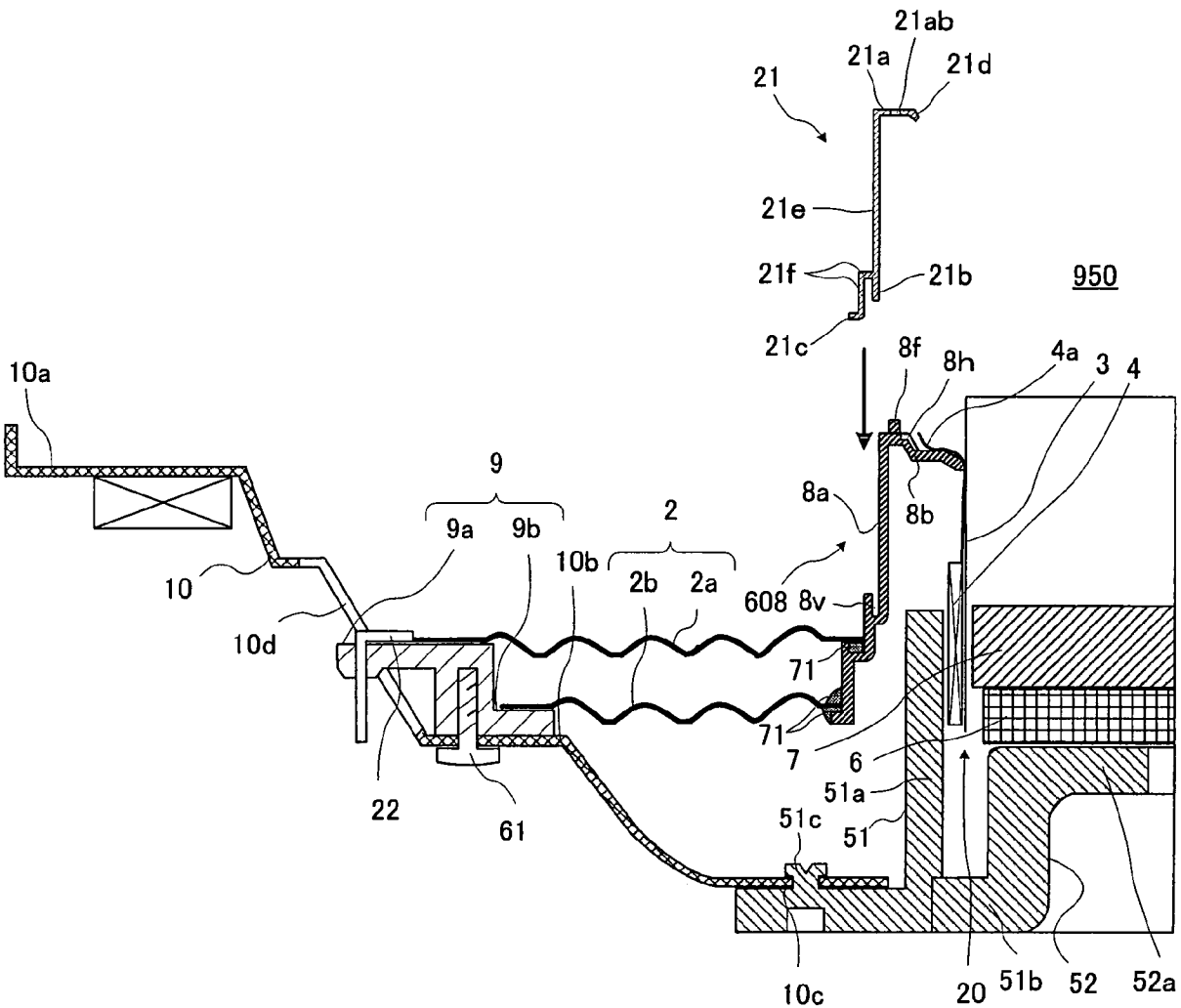
FIG. 19 shows a sectional view of a manufacturing process of the speaker device.
Figure 20:
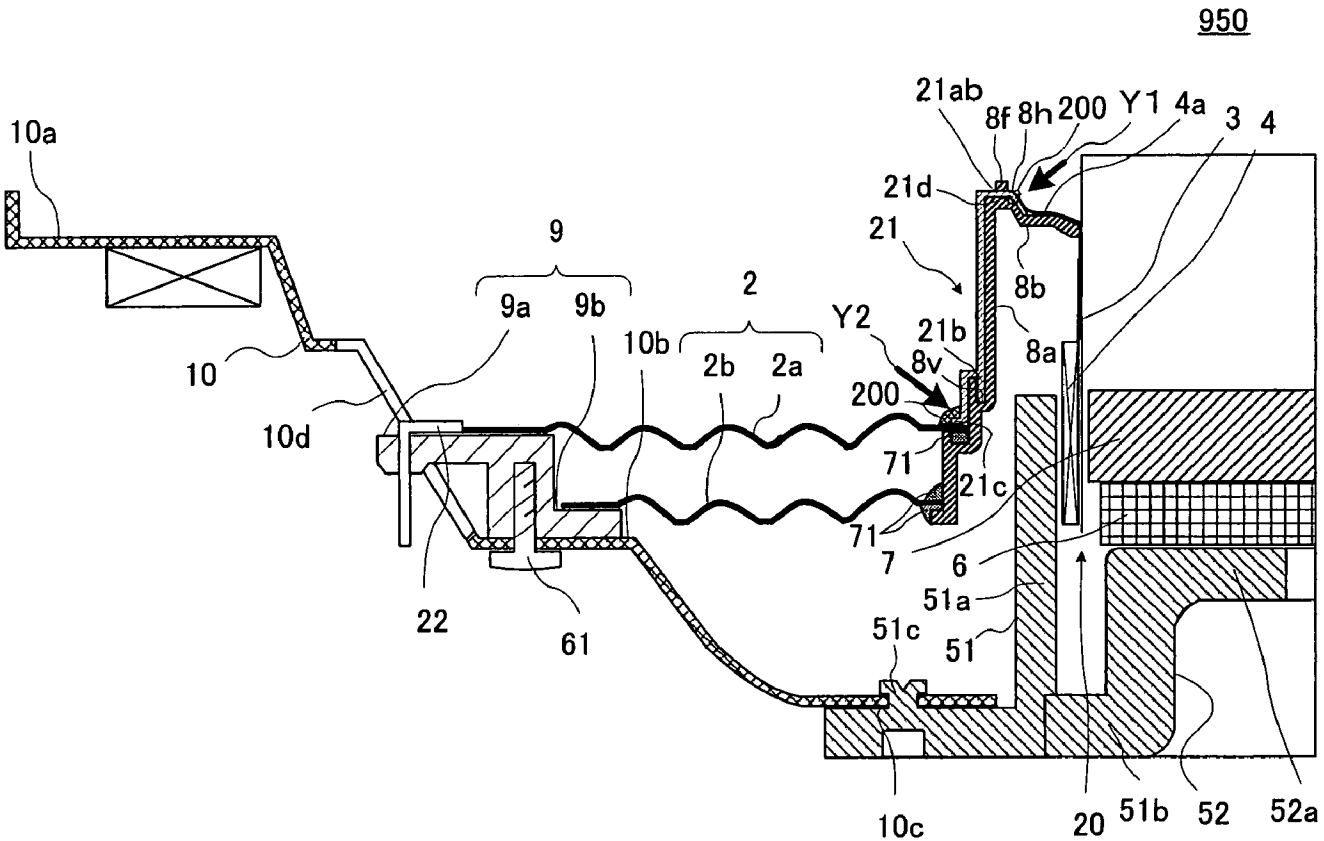
FIG. 20 shows a sectional view of the manufacturing process of the speaker device.
Figure 21B:
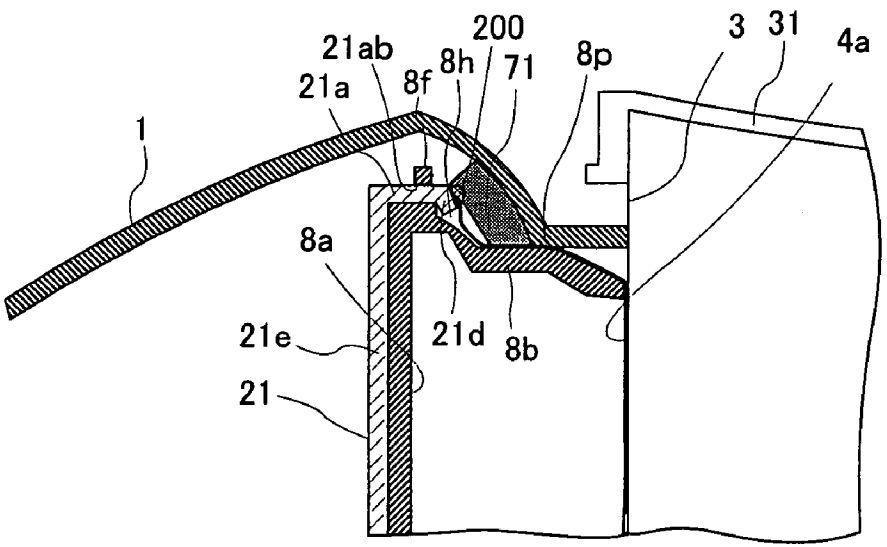
FIGS. 21A and 21B show sectional views of local parts of the speaker device.
Figure 21A:
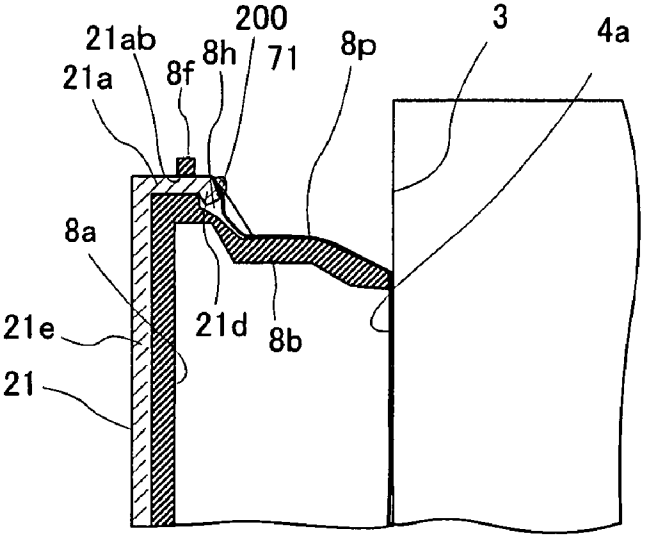
Figure 22B:
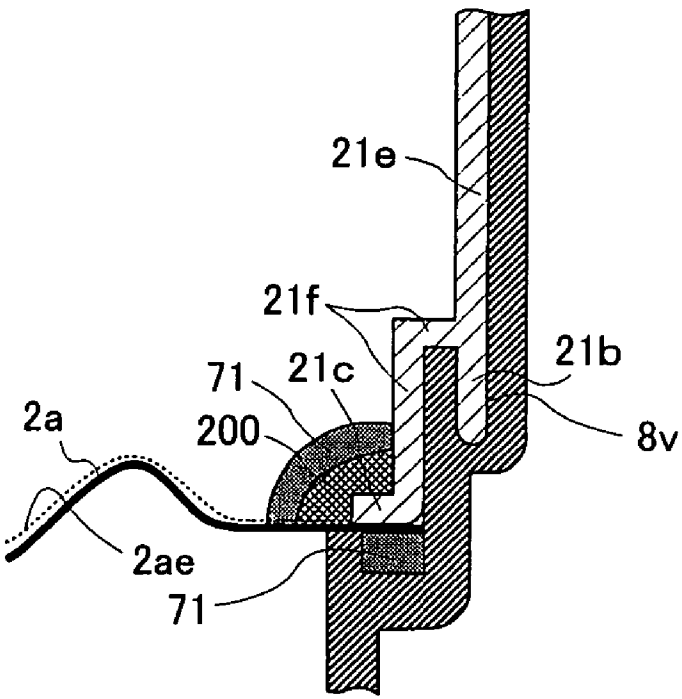
FIGS. 22A and 22B show sectional views of the local parts of the speaker device.
Figure 22A:
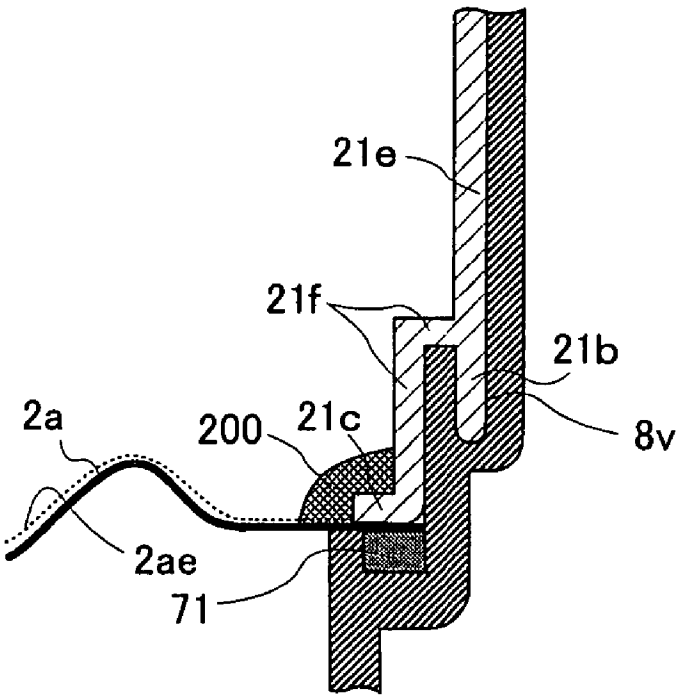

Next, a manufacturing method of the speaker device 100 of the present invention will be described by referring to FIGS. 18 to 22. FIG. 18 shows a flow chart of the manufacturing method of the speaker device 100. FIGS. 19 and 20 show a manufacturing process of the speaker device 100. FIG. 21A shows an enlarged sectional view of a local part in the vicinity of the arrow Y1 in FIG. 20. FIG. 21A is also the enlarged sectional view of a local part of a state in which the lead wire 4*a* of the voice coil 4 and the connecting part 21*d* of the terminal member 21 are soldered with the soldering 200. FIG. 21B is an enlarged sectional view of the local part corresponding to FIG. 21A. FIG. 21B is also the enlarged sectional view of the local part in the state in which portions of the connecting part 21*d* and the lead wire 4*a* connected by soldering is reinforced with the adhesive 71. FIG. 22A shows an enlarged sectional view of a local part in the vicinity of the arrow Y2 in FIG. 20. FIG. 22A is also an enlarged sectional view of a local part in the state in which the conductive member 2*ae* of the conductive damper 2*a* and the connecting part 21*c* of the terminal member 21 are soldered. FIG. 22B is an enlarged sectional view of the local part corresponding to FIG. 22A. FIG. 22B is also an enlarged sectional view of the local part in the state in which the portions of the connecting part 21*c* and the conductive member 2*ae* connected by soldering is reinforced with the adhesive 71.

First, as shown in FIG. 19, in the speaker unit 950 which is in the state it is assembled to some extent, the terminal member 21 is mounted to the terminal mounting part 608 of the connecting member 8 (step S1). More specifically, the projecting portion 8*f* of the connecting member 8 is inserted into the hole 21*ab* of the terminal member 21 and the fixing part 21*b* of the terminal member 21 is inserted into the groove 8*v* of the connecting member 8. Thereby, as shown in FIG. 20, the terminal member 21 is fixed to the connecting member 8 in the state in which the connecting part 21*c* of the terminal member 21 is connected to the conductive member 2*ae* of the conductive damper 2*a*. Thus, according to the fixing structure of this terminal member 21 and the connecting member 8, the terminal member 21 and the connecting member 8 are physically fixed at the two positions as described above. Therefore, the terminal member 21 does not lift from the connecting member 8, and the soldering operation of the connecting part 21*c* of the terminal member 21 and the conductive member 2*ae* of the conductive damper 2*a* can be easily performed.

Next, the terminal member is soldered to the lead wire 4*a* of the voice coil 4 and the conductive damper 2*a*, respectively (step S2). More specifically, the lead wire 4*a* of the voice coil 4 is wound around the hole 21*ab* of the connecting part 21*a* of the terminal member 21 (see FIG. 8). With this, soldering is performed for this portion as shown in FIG. 20 and FIG. 21A. As shown in FIG. 20 and FIG. 22A, soldering is performed for the portions of the connecting part 21*c* of the terminal member 21 and the conductive member 2*ae* of the conductive damper 2*a*. Thereby, the voice coil 4 and the conductive damper 2*a* are electrically connected via the terminal member 21.

Next, as shown in FIG. 21B, at the same time when the bent portion 8*b* of the connecting member 8 and the inner peripheral edge portion of the diaphragm 1 are bonded with the adhesive 71, the upper end portion of the terminal member 21 is bonded to them (step S3). As shown in FIG. 22B, at the same time when the outer peripheral wall of the cylinder portion 8*a* of the connecting member 8 and the inner peripheral edge portion of the conductive damper 2*a* are bonded with the adhesive 71, the lower end portion of the terminal member 21 is bonded to them (step S3). Thus, by one applying operation of the adhesive 71, the upper end portion of the terminal member 21, the connecting member 8 and the diaphragm 1 can be fixed, and the lower end portion of the terminal member 21, the connecting member 8 and the conductive damper 2*a* can be fixed. Thereby, the number of assembling steps of the speaker device 100 can be reduced.

Next, by mounting the various kinds of other components, the speaker device 100 shown in FIG. 1 is manufactured.

What is claimed is:

1. A speaker device comprising:

a frame;

a damper having an outer peripheral edge portion supported by the frame;

a connecting member mounted to the damper and movably supporting a voice coil bobbin; and a terminal member electrically connected to an amplifier side and a voice coil side, wherein a projecting part projecting upward is formed at an upper end portion of the connecting member and a groove is formed in a lower end portion of the connecting member, wherein a hole in which the projecting part is inserted is formed in an upper end portion of the terminal member and a fixing part which is inserted into the groove is formed at a lower end portion of the terminal member, and wherein the terminal member is mounted to the connecting member in a state in which the projecting part is inserted into the hole and the fixing part is inserted into the groove.

2. The speaker device according to claim 1, wherein a projecting part projecting to a side of a center axis of the connecting member is formed in the groove, wherein an opening into which the projecting part is inserted is formed in the fixing part, and wherein the projecting part is inserted into the opening.

3. The speaker device according to claim 1, wherein a connecting part of the terminal member is connected to a conductive member of a conductive damper or a tinsel cord.

4. The speaker device according to claim 1, wherein an inner peripheral edge portion of a diaphragm is disposed at the upper end portion of the terminal member.

* * * * *